US007609139B2

(12) United States Patent
Bird et al.

(10) Patent No.: US 7,609,139 B2
(45) Date of Patent: Oct. 27, 2009

(54) SPLIT FLORIDA-HELIX MAGNET

(75) Inventors: Mark D. Bird, Tallahassee, FL (US); Scott T. Bole, Tallahassee, FL (US); Scott R. Gundlach, Tallahassee, FL (US); Jack Toth, Tallahassee, FL (US)

(73) Assignee: Florida State University Research Foundation, Tallahassee, FL (US)

( * ) Notice: Subject to any disclaimer, the term of this patent is extended or adjusted under 35 U.S.C. 154(b) by 260 days.

(21) Appl. No.: 11/716,492

(22) Filed: Mar. 9, 2007

(65) Prior Publication Data

US 2007/0210884 A1 Sep. 13, 2007

Related U.S. Application Data

(60) Provisional application No. 60/781,104, filed on Mar. 10, 2006.

(51) Int. Cl.
*H01F 5/00* (2006.01)

(52) U.S. Cl. ..... 335/299; 335/216; 335/296; 335/300; 335/301; 174/15.4; 174/15.5; 174/15.6; 336/155; 336/165; 361/141; 361/142; 361/143

(58) Field of Classification Search ..... 335/216, 335/296, 299–301; 174/15.4–15.6; 336/155, 336/165; 361/141–143
See application file for complete search history.

(56) References Cited

U.S. PATENT DOCUMENTS 3,090,894 A * 5/1963 Post et al. ..... 335/216
3,227,930 A * 1/1966 Hnilicka, Jr. ..... 335/216
3,376,528 A * 4/1968 Macy ..... 335/296
4,061,007 A * 12/1977 Hansen et al. ..... 72/56
4,774,487 A * 9/1988 Aubert ..... 335/299
4,794,358 A * 12/1988 Steingroever et al. ..... 335/299
4,808,954 A * 2/1989 Ito ..... 335/216
4,823,101 A * 4/1989 Aubert ..... 335/299
7,015,779 B2 * 3/2006 Markiewicz et al. ..... 335/299
7,068,134 B2 * 6/2006 Olsen ..... 335/291
7,078,993 B2 * 7/2006 Berg et al. ..... 335/299
7,215,230 B2 * 5/2007 Niemann et al. ..... 335/216
2003/0184427 A1 * 10/2003 Gavrilin et al. ..... 336/200

* cited by examiner

*Primary Examiner*—Elvin G Enad
*Assistant Examiner*—Mohamad A Musleh
(74) *Attorney, Agent, or Firm*—J. Wiley Horton

(57) ABSTRACT

An electromagnet having at least one access port oriented perpendicularly to the electromagnet's central axis. The magnet has a conventional helical winding along its central axis. However, at some point along the length of the axis, the pitch of the helical winding is greatly increased in order to create a region with a comparatively low turn density. One or more ports are provided in this region. These ports provide access from the magnet's central bore to the magnet's exterior. A sample can be placed in the central bore near the ports. A beam traveling down the central bore, or through one of the radial ports, will strike the sample and be scattered in all directions. The ports allow access for instrumentation which is used to evaluate the scattered beam.

16 Claims, 27 Drawing Sheets

SPLIT FLORIDA-HELIX MAGNET

CROSS-REFERENCES TO RELATED APPLICATIONS

This is a non-provisional application claiming the benefit—pursuant to 37 C.F.R. §1.53(c) of an earlier-filed provisional application. The provisional application was filed on Mar. 10, 2006 and was assigned application Ser. No. 60/781,104. The provisional application listed the same inventors.

STATEMENT REGARDING FEDERALLY SPONSORED RESEARCH OR DEVELOPMENT

This invention was developed at the National High Magnetic Field Laboratory in Tallahassee, Fla., U.S.A. The research and development has been federally sponsored.

MICROFICHE APPENDIX

Not Applicable

BACKGROUND OF THE INVENTION

1. Field of the Invention

This invention relates to the field of electromagnets. More specifically, the invention comprises a resistive magnet with radial ports providing access to the central region.

2. Description of the Related Art

The present invention proposes to create an electromagnet having a split at the mid-plane in order to allow clear radial access to the magnet's core. Several approaches may be useful for constructing such a magnet. It is therefore important for the reader to understand some known techniques for electromagnet construction prior to receiving the description of the present invention.

A good discussion of prior art construction techniques for high-field resistive magnets is found in an article written by one of the present inventors: Mark D. Bird, "Resistive Magnet Technology for Hybrid Inserts," *Superconductor Science and Technology*, vol. 17, 2004, pp. R19-R33. Discussions of prior art construction techniques for high-field split resistive magnets are found in two articles published in the *IEEE Transactions on Magnetics*: Robert J. Weggel and M. J. Leupold, "A 17.5-Tesla Magnet with Multiple Radial Access Ports," vol. 24, no. 2, March 1988, pp. 1390-1392; and Pierre Rub and G. Maret. "A New 18-T Resistive magnet with Radial Bores," vol. 30, no. 4, July 1994, pp. 2158-2161.

The basic principle of an electromagnet is that a conductor must be wrapped around a central bore for one or more turns. Many turns are typically used. FIG. 1 shows an electromagnet created by wrapping conductor 100 around central bore 104 in a helical path. The two ends of the helical path may be provided with a flat 30 to facilitate mounting the coil. Helical gap 28 is typically filled with an insulator of some sort to ensure that the current flows through the helical path.

The version shown in FIG. 1 does not show any cooling channels. For the conductor to carry large currents, cooling channels would need to be added. Radial cooling channels can be cut using wire EDM to make a "Monohelix" magnet as described by Weggel in "The Monohelix: 1) Five Years of Operation at the Francis Bitter National Magnet Laboratory" and 2) Finite Element Stress Analysis," *IEEE Trans. on Magn.*, vol. 28, no. 1, January 1992. In the alternative, axial cooling channels can be cut via micro-hole and wire EDM to make a Florida-Helix as described by one of the present inventors, Mark D. Bird, in "Florida-Helix Resistive Magnets," *IEEE Trans. on Applied Supercond.*, vol. 14, no. 2, 2004, pps. 1271-1275. As a Florida-helix is a recent development, the drawing figures depicting it are not described as "prior art."

The electrical current passing through the helix during operation generates Lorentz forces and considerable heat. Other components are needed to accommodate these factors. The whole device is placed within a surrounding jacket, so that a pressurized fluid can be pumped through the cooling channels. Mechanical attachment features are generally also provided. For purposes of visual clarity, these features have been omitted in FIG. 1.

Bitter-disk type electromagnets are another known approach to carrying high currents. While it is true that those skilled in the art are familiar with the design and construction of such magnets, a brief explanation of the prior art may be helpful. FIG. 2 shows a prior art Bitter-disk magnet. End plate 40 is the anchoring point for a number of circumferentially-spaced tie rods 44. In practice tie rods 44 have uniform length. Some of these are shown cut away in order to aid visualization of other components. A Bitter-disk magnet is typically constructed by stacking the components. Starting with end plate 40, tie rods 44 are added. A series of conducting disks 36 are then slipped onto tie rods 44. The reader will observe that each conducting disk 36 has a series of holes designed to accommodate tie rods 44. Conducting disks 36 are made of thin conductive material, such as copper or aluminum.

Turning briefly to FIG. 4, the reader may observe conducting disk 36 in more detail. Tie rod holes 46 are uniformly spaced around its perimeter. Cooling holes 54 are also uniformly spaced about conducting disk 36. Cut 52 is a radial cut extending completely through one side of the disk. The reader will observe that the two sides of the disk have been displaced vertically, with the result that conducting disk 36 forms one turn of a helix having a shallow pitch. Upper side 50 of cut 52 is higher than lower side 48. The importance of this fact will become apparent as the construction of the device is explained further.

Prior art Bitter magnets are made in several different ways. The specifics of the prior art construction techniques are not critical to the present invention, since the present invention could employ Bitter stacks constructed using any of the prior art techniques. However, in order to aid the understanding of those not skilled in the art, one of the prior art construction techniques will be discussed in detail.

Returning now to FIG. 2, the reader will observe that six conducting disks 36 are initially placed over tie rods 44 (the lowest part of the stack in the view). For the specific version shown, as each conductive disk is stacked, it is indexed 1/15 turn in the clockwise direction (corresponding to the fact that there are 15 tie rods 44). Turning to FIG. 5, the effect of the rotational indexing may be more readily observed.

Six conducting disks 36 have been assembled to create one conductor turn 42. Conducting disks 36 have also been "nested" together. The 1/15 turn is a somewhat arbitrary figure. They could be indexed in other increments. Rotational indexing as large as 1/3 turn is in common use, especially for smaller diameter stacks. In fact, it is more customary to divide the 360 degrees found in one complete turn into even increments. If six stacked conductors are used to make one turn, then it would be common to rotationally index each disk 1/6 turn over its predecessor (60 degree index per disk).

The disks are nested in the manner shown, so that upper side 50 of one conductor disk 36 lies over upper side 50 of the conductor disk 36 just below it. The disks in FIG. 2 are shown with a significant gap between them. The Bitter-disk assembly method squeezes the disks tightly together when the device is complete. The squeezing is typically accomplished by threading the ends of the tie rods. Rigid end plates are slipped over the tie rods at the top and bottom of the stack. Nuts are then threaded onto the exposed ends of the tie rods and tightened to squeeze the end plates toward each other. When squeezed together, conducting disks 36 form one integral conductor having a helical path—albeit with a very shallow pitch.

Still looking at FIG. 2, the description of the prior art device will be continued. The reader will observe that four conductor turns 42 are shown in the assembly (in the uncompressed state). In reality, many such conductor turns 42 will be stacked onto tie rods 44. The desired result is to accommodate a large electrical current flowing through a helix having a shallow pitch. The desired path of current flow commences with one end plate 40 (which makes contact with the underside of the lowermost conducting disk 36). A second end plate 40 (not shown) will form the upper boundary of the assembly ("sandwiching" the other components in between). The current will then exit the device through the upper end plate 40 (The tie rods are electrically isolated from the end plates and the disks so that they will carry no current). Those skilled in the art will realize that if one simply stacks a number of conductor turns 42 on the device, the electrical current will not flow in the desired helix. Rather, it will simply flow directly from the lower end plate 40 to the upper end plate 40 in a linear fashion. An additional element is required to prevent this.

Insulating disks 34 are placed within each conductor turn 42 to prevent the aforementioned linear current flow. Each insulating disk 34 is made of a material having a very high electrical resistance. The dimensional features of each insulating disk 34 (tie rod holes, cooling holes, etc.) are similar to the dimensional features of conducting disks 36. Each conductor turn 42 incorporates at least one insulating disk 34 nested into the stack. FIG. 3 shows a detail of this arrangement. The reader will observe the upper portion and lower portion of each insulating disk 34 (both ends of each disk are labeled as "34" in the view so that the reader may easily distinguish them from conducting disks 36). The reader will also observe how each insulating disk 34 nests into the helix formed by the six conducting disks 36.

FIG. 5 also illustrates this arrangement. Insulating disk 20 is placed immediately over the first conducting disk 36. It then follows the same helical pattern as the conducting disk 36. Returning now to FIG. 2, the cumulative effect of this construction will be explained. The four conductor turns 42 shown in FIG. 2 are identical. When they are compressed together, the four insulating disks 34 will force the current to flow through one continuous helix through the stacked conducting disks 36. Thus, the construction disclosed forces a helical flow of electrical current through the device. An actual Bitter magnet might include 20 or more such conductor turns.

Those skilled in the art will realize that when a substantial electrical current is passed through Bitter magnet 32, strong mechanical forces are created (Lorentz forces). Significant heat is also introduced through resistive losses. Thus, the device must be able to withstand large internal mechanical forces, and it must also be able to dissipate heat. Once the entire device is assembled with the two end plates 40 in place, the end plates are mechanically forced toward each other. The lower ends of tie rods 44 are attached to the lower end plate 40. The upper ends typically pass through holes in the upper end plate 40. The exposed upper ends are threaded so that a set of nuts can be threaded onto the exposed ends of tie rods 44 and tightened to draw the entire assembly tightly together. In this fashion, the device is capable of resisting the Lorentz forces, which tend to move the disks and other components relative to each other. Not all Bitter-type magnets use tie rods. Other mechanical structures can be used to align the components and resist the Lorentz forces. However, since tie rods are the most common approach, they have been illustrated.

Because Bitter magnet 32 generates substantial heat during operation, natural convective cooling is generally inadequate. Forced convective cooling, using deionized water, oil, or liquid nitrogen is therefore employed. A sealed cooling jacket is created by providing an inner cylindrical wall bounded on its lower end by the lower end plate 40, and bounded on its upper end by the upper end plate 42. An outer cylindrical wall is provided outside the outer perimeter of the disks, extending from the lower end plate 42 to the upper end plate 42. All the components illustrated are thereby encased in a sealed chamber. The cooling liquid is then forced into the cooling jacket, where it flows from one end of the device to the other through the aligned cooling holes in the stacked disks (the cooling holes align in the conducting and insulating disks). In FIG. 2, the cooling flow would typically be linear from top to bottom or bottom to top.

Those skilled in the art will realize that the completed Bitter magnet 32 will generate an intense magnetic field within the cylindrical cavity within the inner cylindrical wall. Those skilled in the art will also realize that it is possible to generate an even greater magnetic field by nesting concentric Bitter-type coils. All these components are well known within the prior art of high-field resistive magnet construction. However, the reader should be aware that the history of high-field split magnet construction is much more limited, with only a few magnets having been built. Most of these were built by Weggel and Rub. In both those cases, radial access ports are provided by "interrupting" the Bitter coil at the mid-plane and introducing a copper or brass "mid-plate" that includes the access ports along with the water channels.

The conducting disk shown in FIG. 4 uses round tie rod holes and round cooling holes. Any discontinuity in the cross section of the disk causes structural weakness and imperfections in the magnetic field produced. Viewed only from the standpoint of electromagnetic efficiency, the disk would ideally have no holes at all. Such a design would be impractical, however, since it could not be effectively cooled. The lack of tie rods would also prevent the disks being effectively aligned and clamped together in order to resist Lorentz forces. Thus, the design of a Bitter-type magnet inherently involves compromises between purity of the magnetic field, conductivity, mechanical strength, cooling, and other factors.

In recent years the traditional Bitter disk design has been improved to remedy some of its shortcomings. FIG. 6 shows a conducting disk developed at the National High Magnetic Field Laboratory in Tallahassee, Fla., U.S.A. This type of disk is now known as a Florida-Bitter disk.

As the tie rods are loaded primarily in tension, a non-round shape can be used. An elongated cross section for the tie rod provides a better compromise between the strength required and the space consumed. Such tie rods are now used. Florida-Bitter disk 56 has elongated tie rod holes 58 to accommodate the modified cross section of the tie rods. The shape of the tie rods conform to the shape of the holes illustrated.

Elongated cooling holes also provide a more advantageous strength versus cooling compromise. Florida-Bitter disk 56 has cooling slots 60 in place of the conventional cooling holes. A series of such cooling slots are placed in concentric rings across the width of the disk.

FIG. 7 shows a detailed view of a portion of Florida-Bitter disk 56, wherein these features can be seen more clearly. The reader will observe that successive circumferential arrays of cooling slots are staggered. If one starts with the innermost array of slots, the next outward array is staggered so that the slots in that array are outboard of the webs (the solid material between the slots) in the preceding array. This staggering of the cooling channels substantially enhances the mechanical strength of the conductor allowing higher fields to be attained. It is an important feature of the Florida-Bitter disk.

From these descriptions, the reader will gain some understanding of the construction of high-field resistive magnets. All these techniques can potentially be used in constructing a magnet according to the present invention, which contemplates providing radial access ports which are approximately perpendicular to the central axis running through the magnet's core.

The inclusion of a radial access port is known within the art. Technical articles have described such designs, including: R. J. Weggel, M. J. Leupold, "A 17-Tesla Magnet with Multiple Radial Access Ports", *IEEE Transactions on Magnetics*, Vol. 24, No. 2, March 1988; and P. Rub, G. Maret, "A New 18 T Resistive Magnet with Radial Bores", *High Magnetic Field laboratory*, Grenoble, France.

Prior art radial port designs have focused on Bitter stacks using radial cooling, meaning that the cooling flows from the central bore out to the magnet's perimeter (rather than longitudinal cooling in a direction parallel to the magnet's central axis). Some type of spacer plate is typically added in the magnet's mid-plane. FIG. 20 shows two spacer plates 106. Each has a pair of radial access grooves 108. Each also has an array of radial cooling channels 110. When the two spacer plates shown are forced together and sealed within suitable cooling fluid manifolds, the two radial access grooves provide access to the magnet's core in the transverse direction.

FIG. 20 shows a very simplified incarnation of this concept. The spacer plates are clamped in the middle of stacks of Bitter disks. The Bitter disks typically have etched radial cooling passages. Those skilled in the art will readily appreciate how the use of radial cooling passages facilitates the inclusion of radial access ports, since the cooling passages and the access ports both proceed from the magnet's core to its perimeter. The present invention seeks to add radial access ports to a coil using longitudinal cooling. A different approach is therefore needed.

Those skilled in the art will realize that the spacer plate shown in FIG. 20 does not allow helical flow of the electrical current. It is simply an electrical "shunt" which passes the current from the Bitter stack clamped on the top of the spacers to the Bitter stack clamped on the bottom of he spacers. This current—which would flow from top to bottom in the orientation shown in the view—does not contribute to creating a magnetic field in central bore 104. Thus, the design shown in FIG. 20 sacrifices some field strength. The reader may naturally wish to know the significance of this sacrifice, since the relatively brief interruption in the helical current path caused by the inclusion of the spacer plates may not be intuitively significant.

FIG. 21 is a cross section through ¼ of a Bitter-type resistive magnet. Only the upper right quadrant is shown. The cross section is of course symmetric about the X axis (labeled as "RADIUS" in the view) and the Z axis (which correspond to the central axis of the magnet). Thus, the X axis shown in the view is the magnet' mid plane. If spacers such as shown in FIG. 20 are used, they will be placed on the X axis in the view.

The figure depicts the winding of a 30 Tesla magnet, using three concentric Bitter coils (first Bitter coil 80, second Bitter coil 82, and third Bitter coil 84). The Bitter coils are divided into regions. The contribution of each region—stated in Teslas per Megawatt—is then shown for each region. As an example, the region of first Bitter coil 80 actually lying next to the magnet's mid-plane, contributes 7.24 T/MW. From even a cursory inspection of this figure, one can conclude that the contribution of conductive turns lying near the magnet's mid-plane to the overall magnetic field produced is substantial. Thus, any sacrifice of turns in this area has a large impact. This fact represents a crucial disadvantage of the approach shown n FIG. 20. Thus, a new construction which can provide access ports through the mid plane while retaining the helical current path would be desirable.

BRIEF SUMMARY OF THE INVENTION

The present invention comprises an electromagnet having radial access ports near its mid-plane. The magnet has a conventional helical winding along a central axis. However, at some point along the length of the axis, the pitch of the helical winding is greatly increased in order to create a region with a comparatively low turn density. One or more radial ports are provided in this region. These ports provide access from the magnet's central bore to the magnet's exterior.

In a first type of experiment, a sample can be placed in the central bore near the ports. A beam traveling down the central bore, or through one of the radial ports, will strike the sample and be scattered in all directions. The ports allow access for instrumentation which is used to evaluate the scattered beam.

In a second type of experiment, a sample can be installed via one of the radial ports and then rotated while the high magnetic field is maintained. Such a technique would be used to measure the variance of the material's properties as it is rotated into different orientations (anisotropy).

The magnet can be created using two or more nested coils. The interior coil or coils are preferably constructed as Florida helices stacked with Florida Bitter disks. The outer coil or coils are preferably constructed as interrupted Bitter coils.

REFERENCE NUMERALS IN THE DRAWINGS

| | | | |
|---|---|---|---|
| 10 | split Florida-helix | 12 | port |
| 14 | shallow pitch region | 16 | steep pitch region |
| 18 | elliptical port | 20 | upper half split Florida-helix |
| 22 | lower half split Florida-helix | 24 | interface surface |
| 26 | Florida helix | 28 | helical gap |
| 30 | flat | 32 | Bitter magnet |
| 34 | insulating disk | 36 | conducting disk |
| 40 | end plate | 42 | conductor turn |
| 44 | tie rod | 46 | tie rod hole |
| 48 | lower side | 50 | upper side |
| 52 | cut | 54 | cooling hole |
| 56 | Florida-Bitter disk | 58 | elongated tie rod hole |
| 60 | cooling slot | 62 | housing |
| 64 | outer wall | 66 | inner housing |
| 68 | elliptical port bounding wall | 70 | inner port boundary |
| 72 | outer port boundary | 74 | split Florida-helix assembly |
| 76 | Florida-Bitter disk stack | 78 | spacer |
| 80 | first Bitter coil | 82 | second Bitter coil |
| 84 | third Bitter coil | 86 | fourth Bitter coil |
| 88 | outer housing | 90 | inner housing |
| 92 | end cap | 94 | cooling inlet |
| 96 | cooling outlet | 100 | conductor |
| 104 | central bore | 106 | spacer plate |
| 108 | radial access groove | 110 | radial cooling channel |
| 112 | modified cooling slot | 114 | stabilizing pin receiver |
| 116 | straight slot wall | 118 | angled slot wall |
| 120 | coolant | 122 | coolant flow gap |
| 124 | port mid point | 126 | port boundary |
| 128 | port relief surface | | |

DETAILED DESCRIPTION OF THE INVENTION

Figure 1:
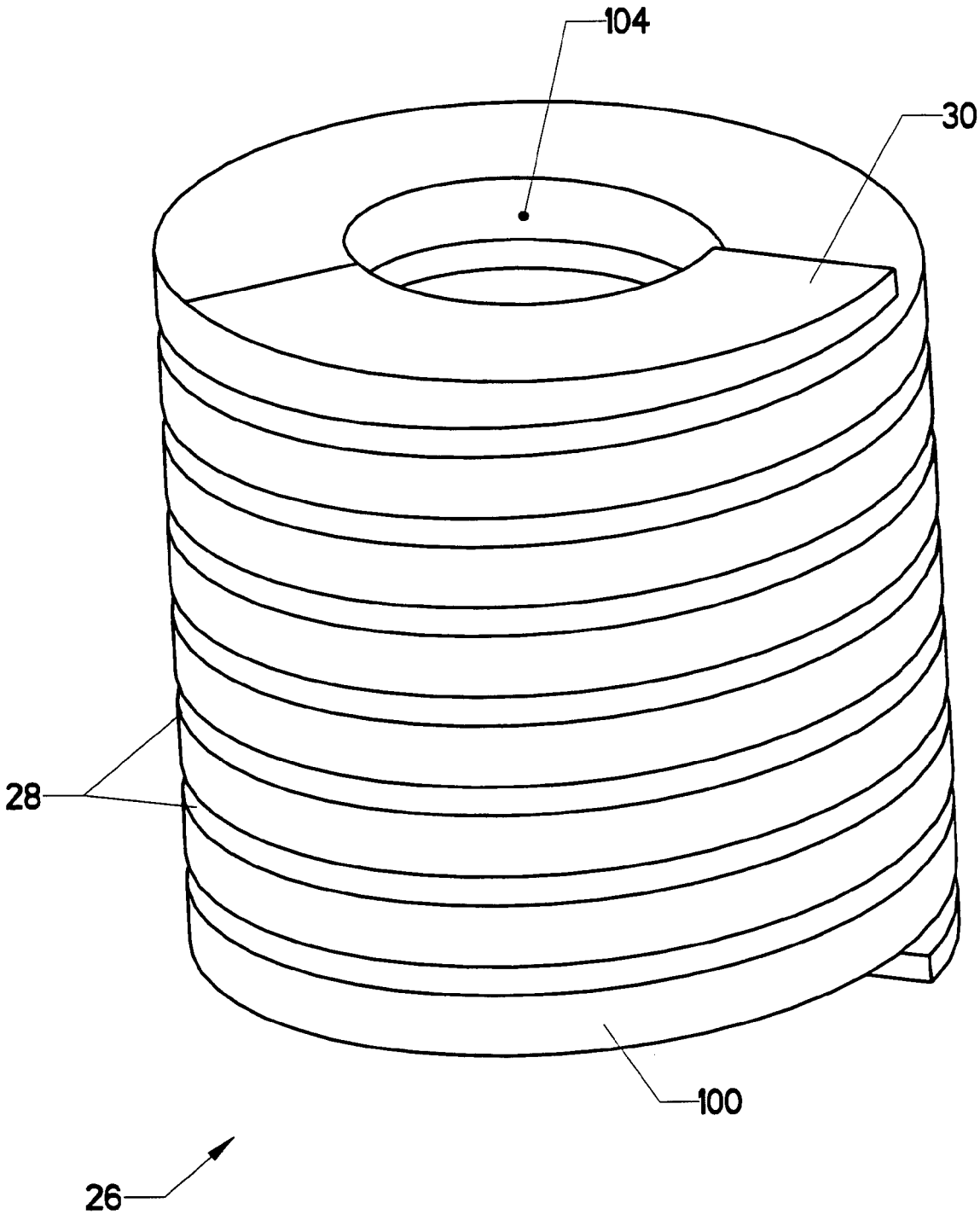
FIG. 1 is a perspective view, showing a conductive helix.
Figure 2:
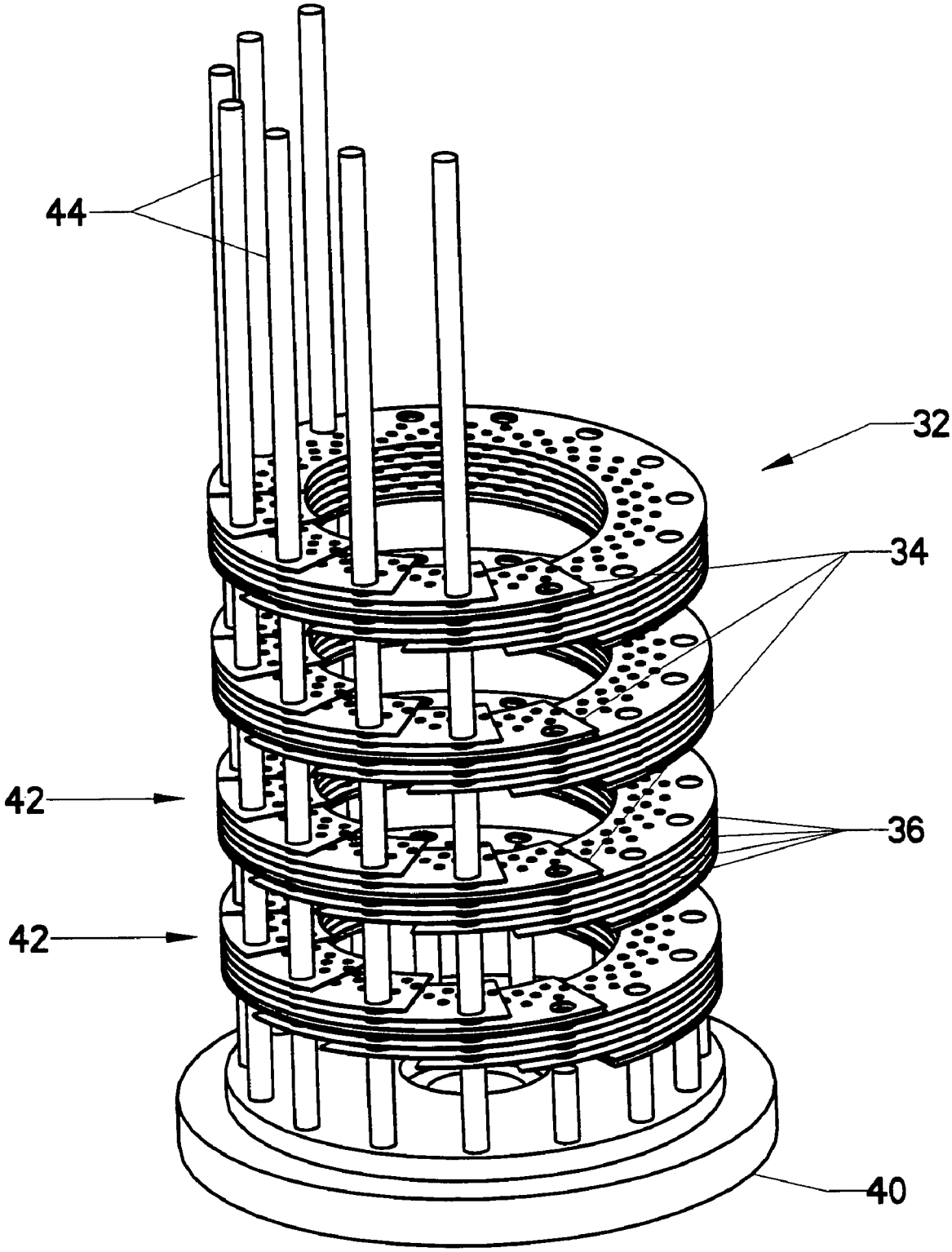
FIG. 2 (PRIOR ART)
FIG. 2 is a perspective view, showing a prior art Bitter-disk magnet.
Figure 3:
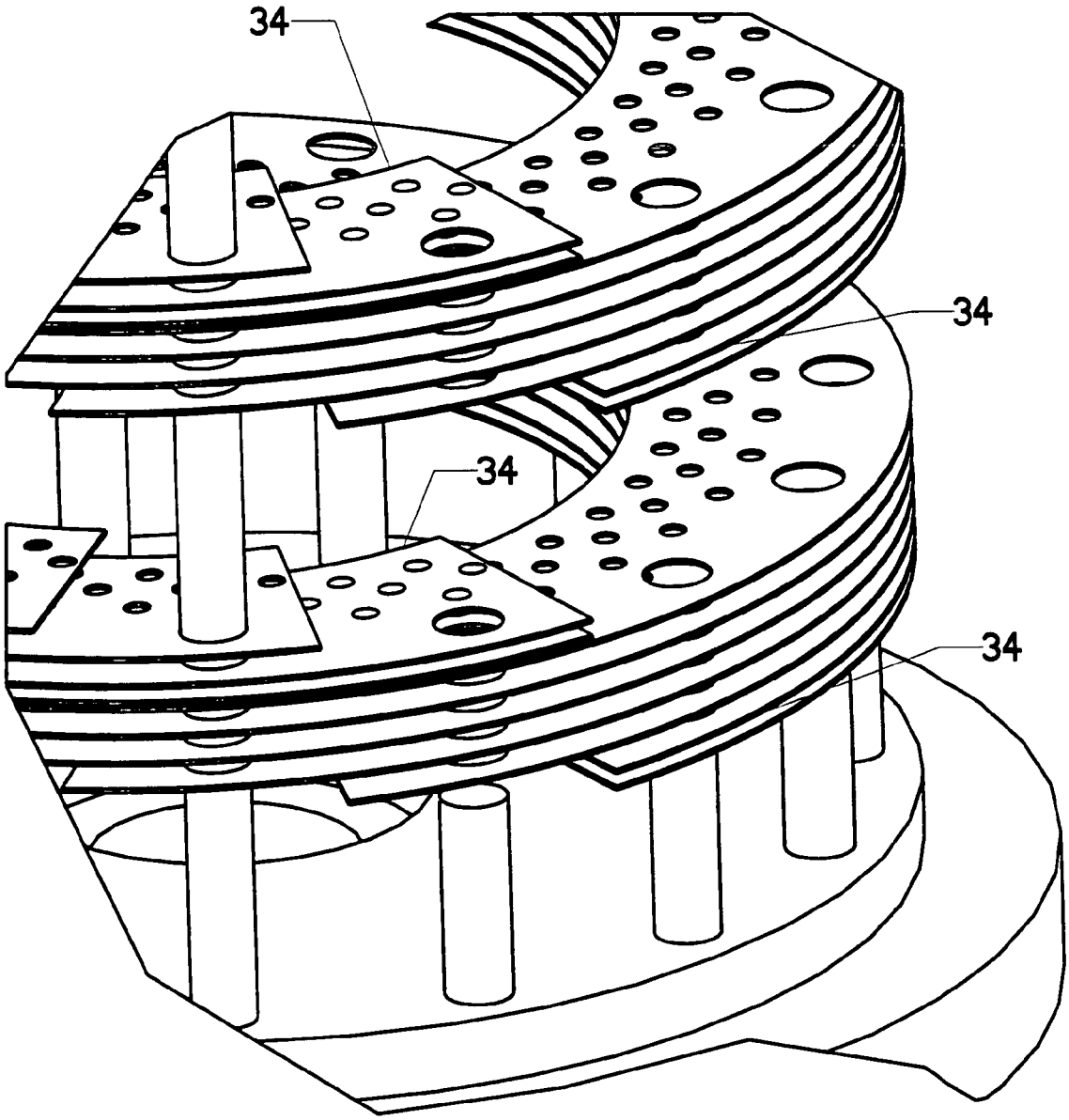
FIG. 3 (PRIOR ART)
FIG. 3 is a detail view, showing a portion of a Bitter-disk magnet.
Figure 4:
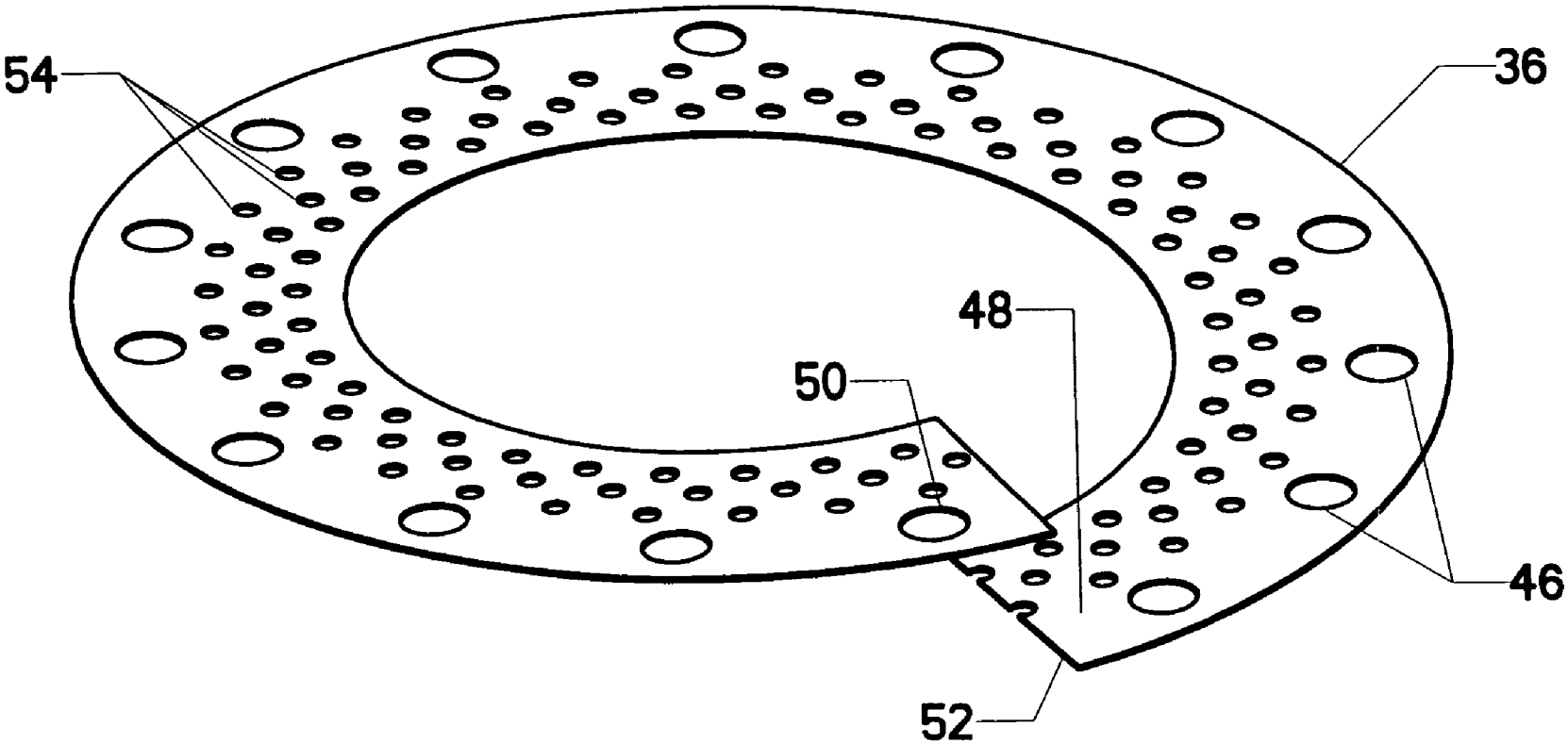
FIG. 4 (PRIOR ART)
FIG. 4 is a perspective view, showing a prior art Bitter-disk.
Figure 5:
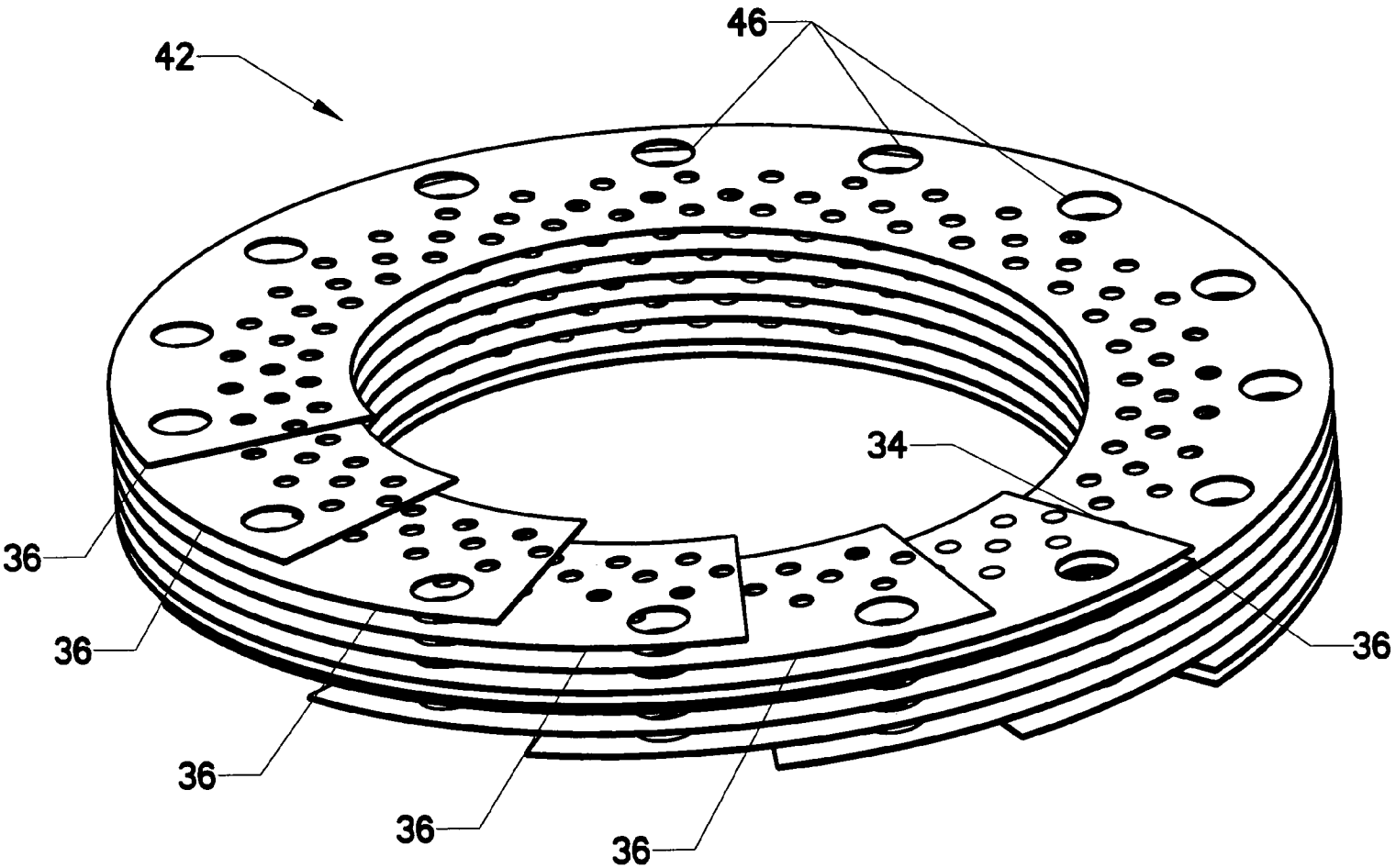
FIG. 5 (PRIOR ART)
FIG. 5 is a perspective view, showing a prior art Bitter-type conductor turn.
Figure 6:
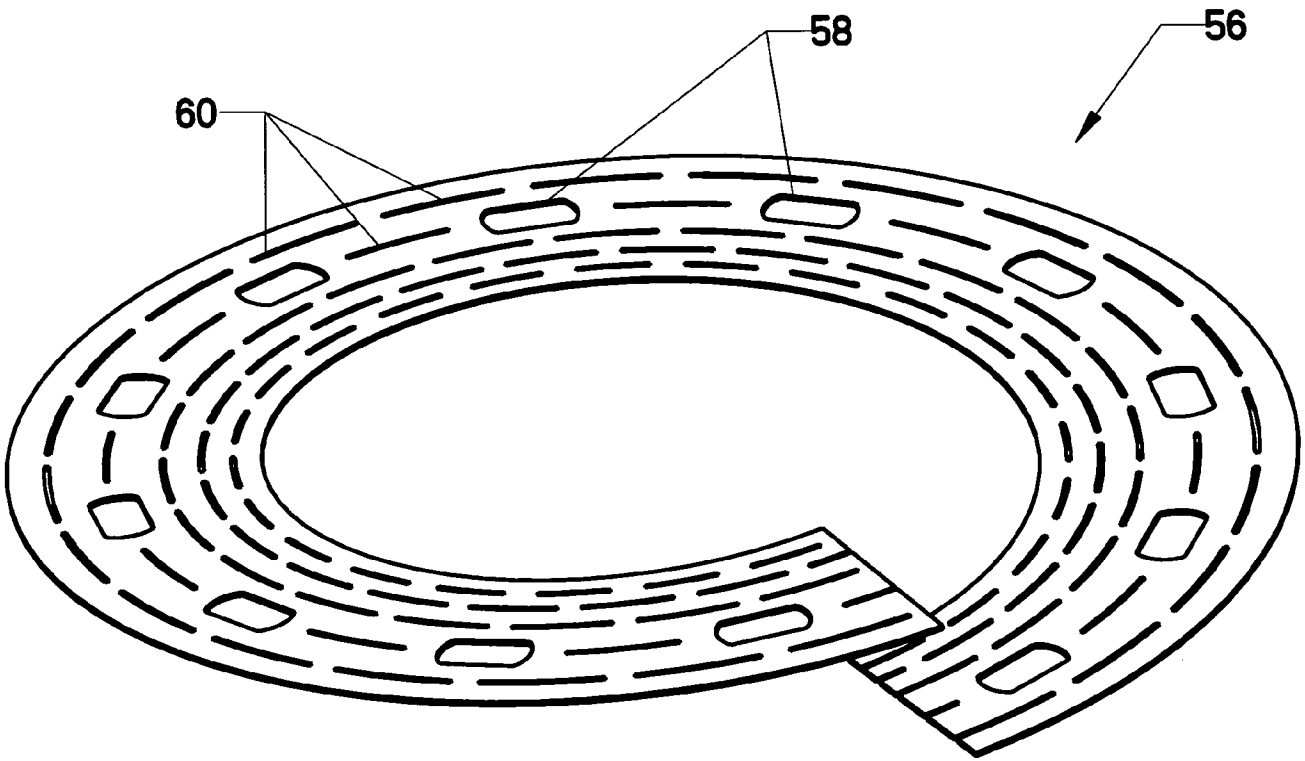
FIG. 6 (PRIOR ART)
FIG. 6 is a perspective view, showing a prior art Florida-Bitter disk.
Figure 7:
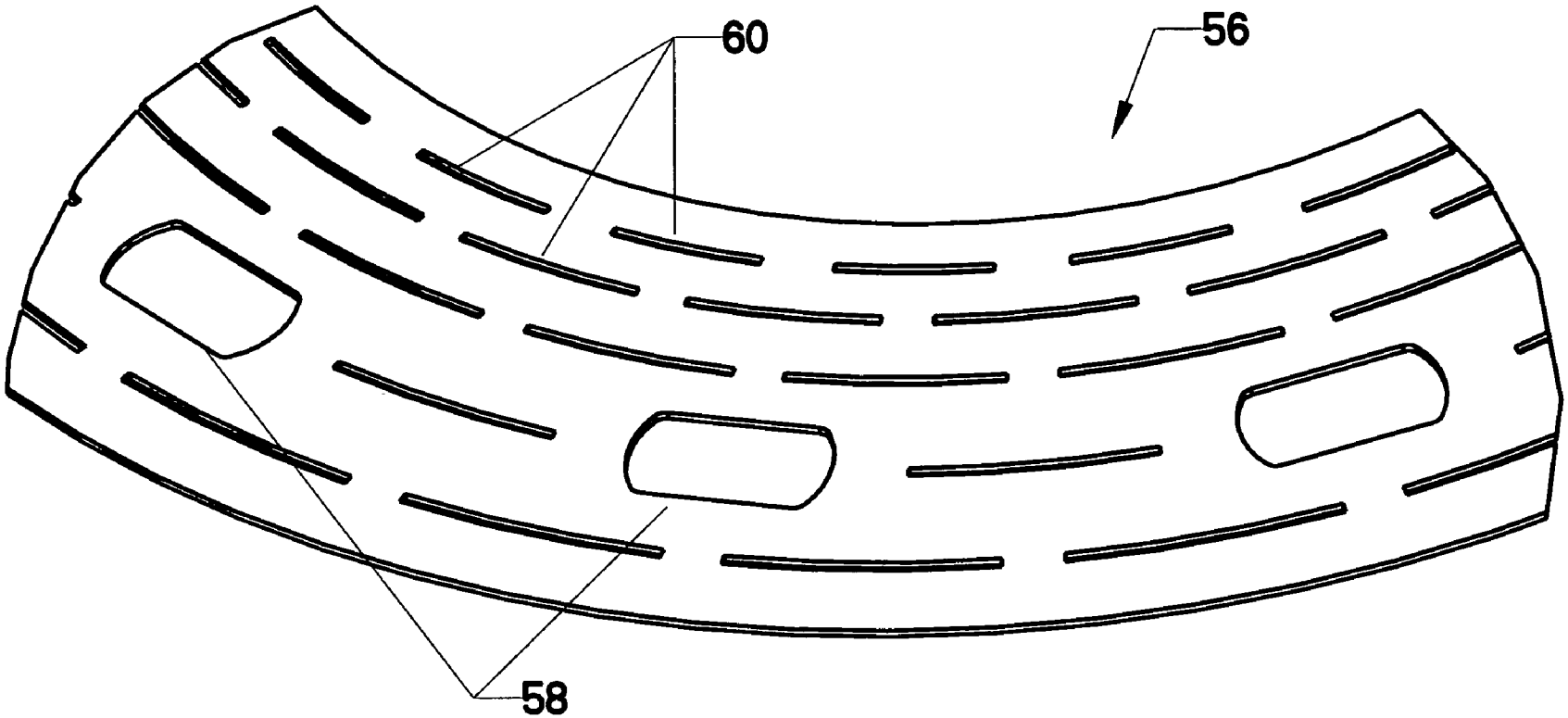
FIG. 7 (PRIOR ART)
FIG. 7 is a detail view, showing a portion of a Florida-Bitter disk.
Figure 8:
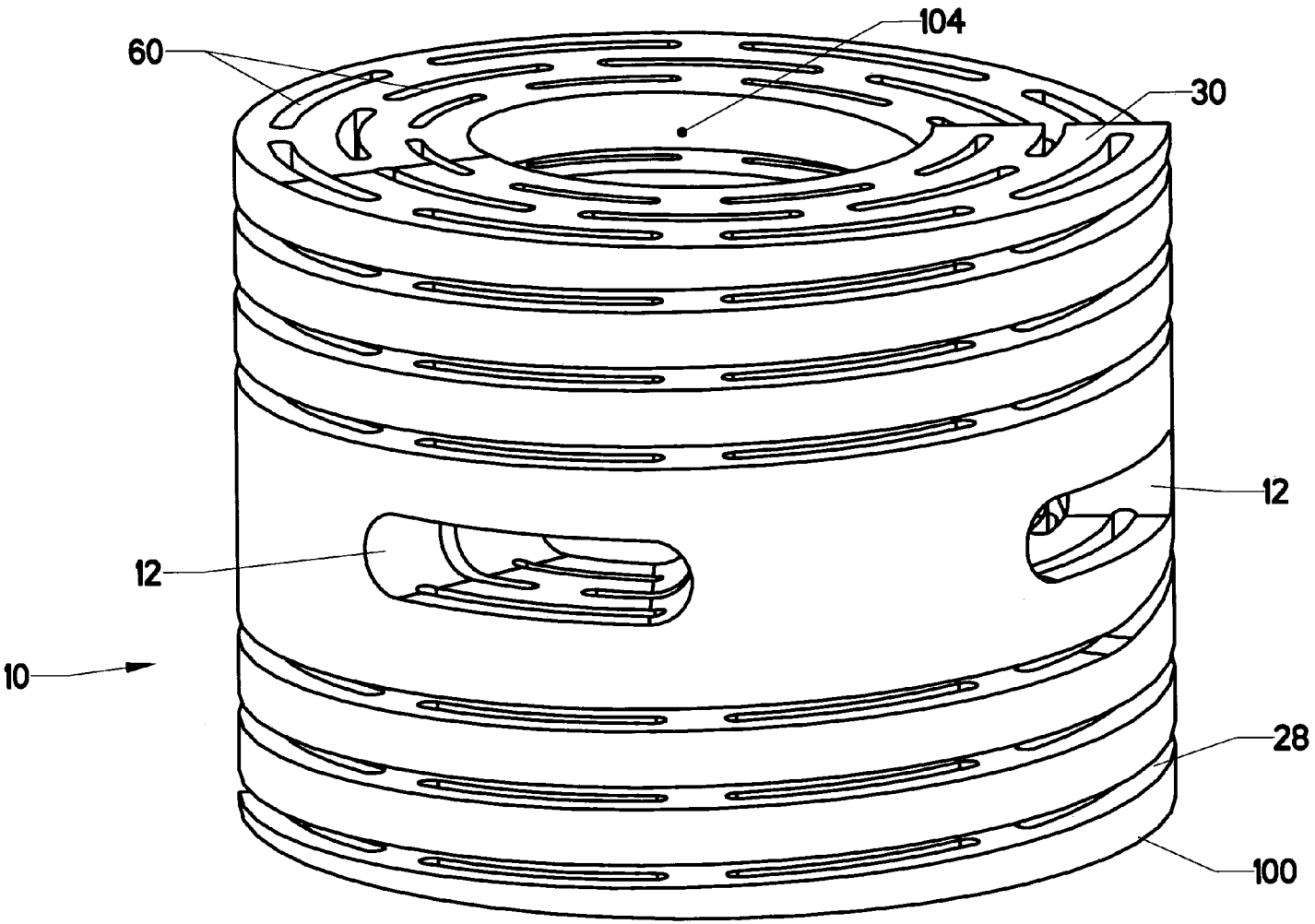
FIG. 8 is a perspective view, showing a split Florida-helix.

The present invention is a resistive magnet having access ports proximate its mid-plane. The reader will recall that FIG. 1 shows a helix. Such a coil can be modified to create a split near its mid plane in order to allow for radial access ports. FIG. 8 shows a Florida-helix incorporating this modification (denoted as split Florida-helix 10). It incorporates a helically wrapped conductor 100 around a central bore 104. Flats 30 are preferably provided on either end. Cooling slots 60 are also provided, in a configuration similar to that shown for the Florida-Bitter disk in FIGS. 6 and 7. In actuality, the cooling slots may be smaller and more numerous. Larger slots are shown for purposes of visual clarity.

As for the conventional Florida-helix, the embodiment shown in FIG. 8 can be created by cutting a helically-wound gap 28 through a cylindrical "blank." The gap is typically cut using a wire EDM process. Four ports 12—radially arrayed at 90 degree increments—are cut from the coil's exterior into central bore 104. The ports diverge as one proceeds away from the coil's central axis. In other words, they grow wider proceeding towards the coil's exterior. This allows a more free path for emissions coming from a sample located in the coil's bore. The reader should note that the choice of four ports is somewhat arbitrary. Two, three, six, eight, or even twelve ports could be included.

Figure 9:
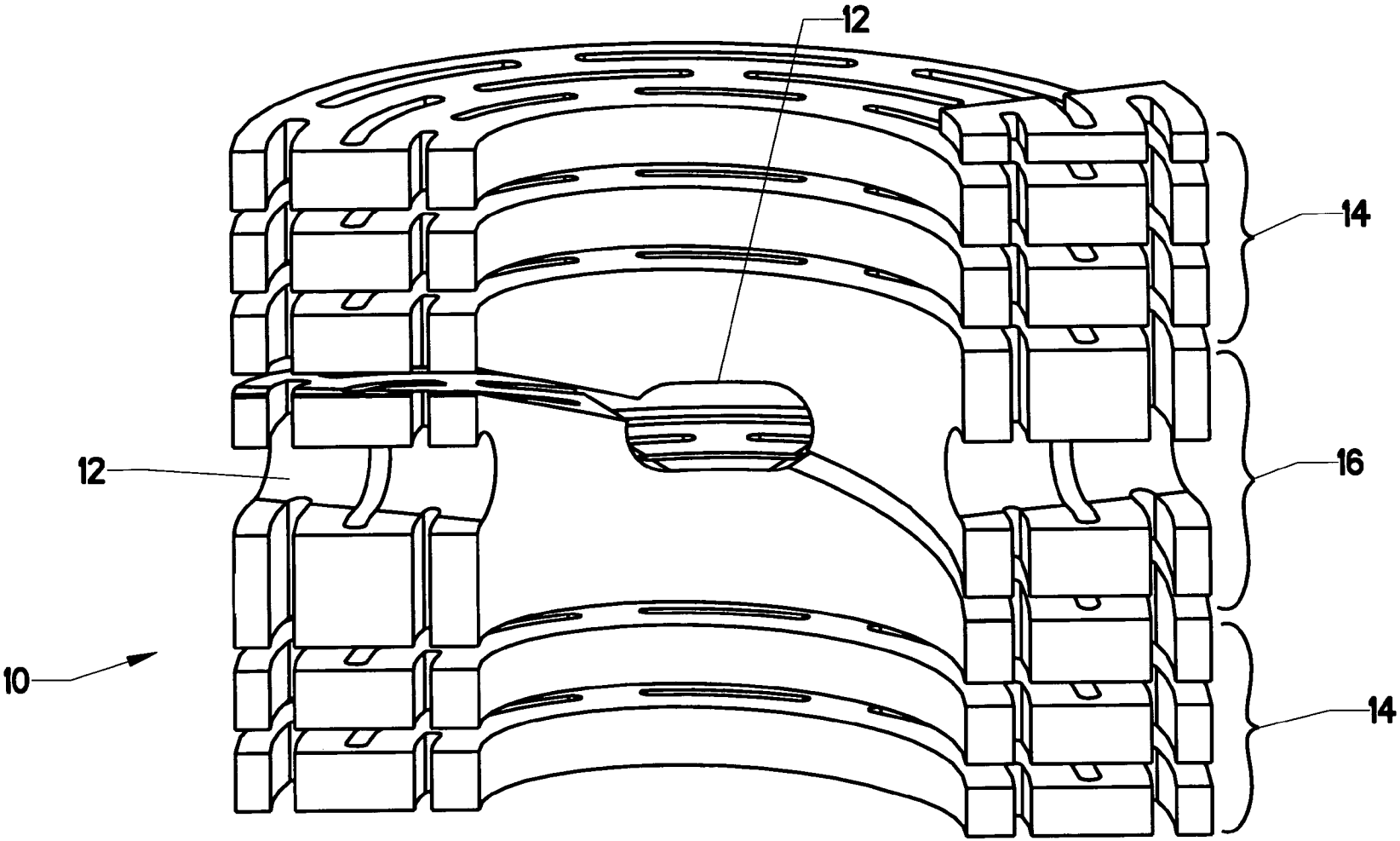
FIG. 9 is a section view, showing internal details of the embodiment of FIG. 8.

Although the use of diverging ports is preferred for some applications, straight ports (which may be easier to manufacture) could also be used. The reader will observe that in the vicinity of these ports (whether diverging or not), the pitch of the helical gap is altered. FIG. 9 better illustrates this feature. In FIG. 9, the split Florida-helix has been sectioned in half through two of the ports 12. In the upper and lower portions of the coil the pitch of the helical gap 28 is constant and relatively shallow (shallow pitch regions 14). However, in the middle portion, the pitch of the helical gap is significantly increased (steep pitch region 16).

Figure 10:
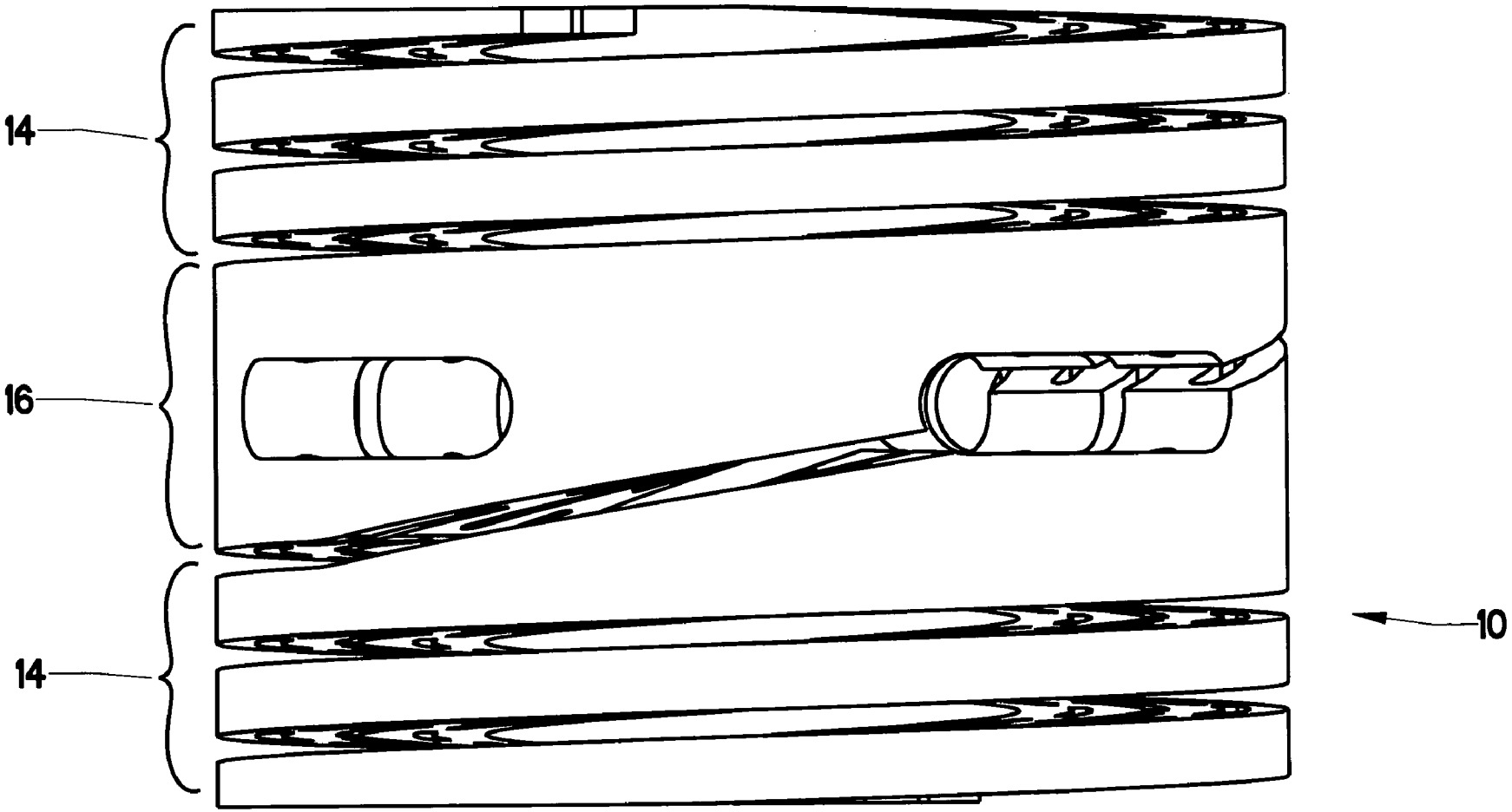
FIG. 10 is an elevation view, showing the winding pitch of the embodiment of FIG. 8.

FIG. 10 shows an elevation view of the coil, rotated to better display the pitch of the helical gap through steep pitch region 16. The helical gap remains continuous. For the specific embodiment shown, the helical gap travels through a shallow pitch, then transitions to a steep pitch, then transitions back to a shallow pitch. The transition between the shallow pitch (high current density) region 14 and the steep pitch (low current density) region 16 can be made via a continuous pitch change or via multiple pitch steps reaching over more or less than one turn. In the fairly simple version of FIG. 10, the current flows through the middle region in approximately one turn. The steep pitch allows the inclusion of the ports without creating a reduced cross section for current flow.

As illustrated, the helical gap passes through only one port. This is not the only way to fabricate the device. It is also possible to have the helical gap stop at one of the ports, then be offset, and resume at another port. The current path would obviously be altered, but the operating principles of the device are the same.

As for the prior Bitter-type magnets, an insulator must be inserted within the helical gap in order to ensure that the electrical current does not short in the direction of the central axis. The insulator, which may be comprised of one piece or many pieces, will occupy helical gap 28. It must incorporate cooling slots which align with those within the split Florida-helix. If tie rod holes are included within the split Florida-helix, then the insulator will have to incorporate aligning tie rod holes as well.

The inclusion of the radial ports assists in conducting experiments. In a first type of experiment, a sample will typically be placed in the center of the magnet's core, proximate the ports. A beam will then be directed in one end of the magnet, through central bore 104. The beam will strike the sample, and emissions will then radiate in all directions. Ports 12 can be further optimized to provide better visibility for instruments designed to detect the emissions. In a second type of experiment, a sample can be installed via one of the radial ports and then rotated while the high magnetic field is maintained. Such a technique would be used to measure variations according to the rotation, thereby providing data on anisotropic properties of the sample.

Figure 11:
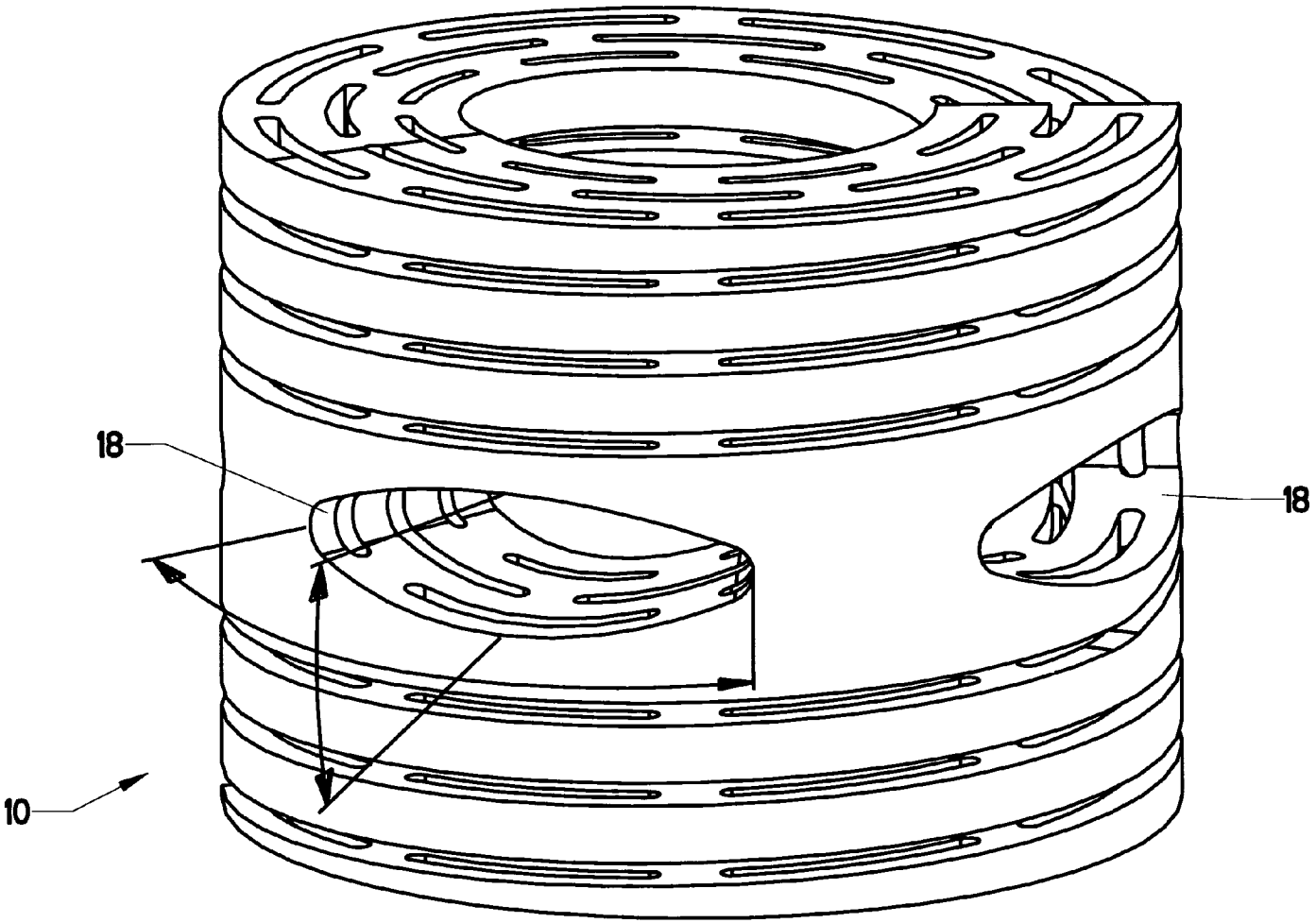
FIG. 11 is a perspective view, showing an elliptical port in a split Florida-helix.

FIG. 11 shows a split Florida-helix incorporating a refined version of the access ports. Elliptical ports 18 diverge in two directions—as depicted by the sets of arrows. This double divergence allows more of the sample emissions to escape and thereby encounter the detecting instruments.

Figure 12:
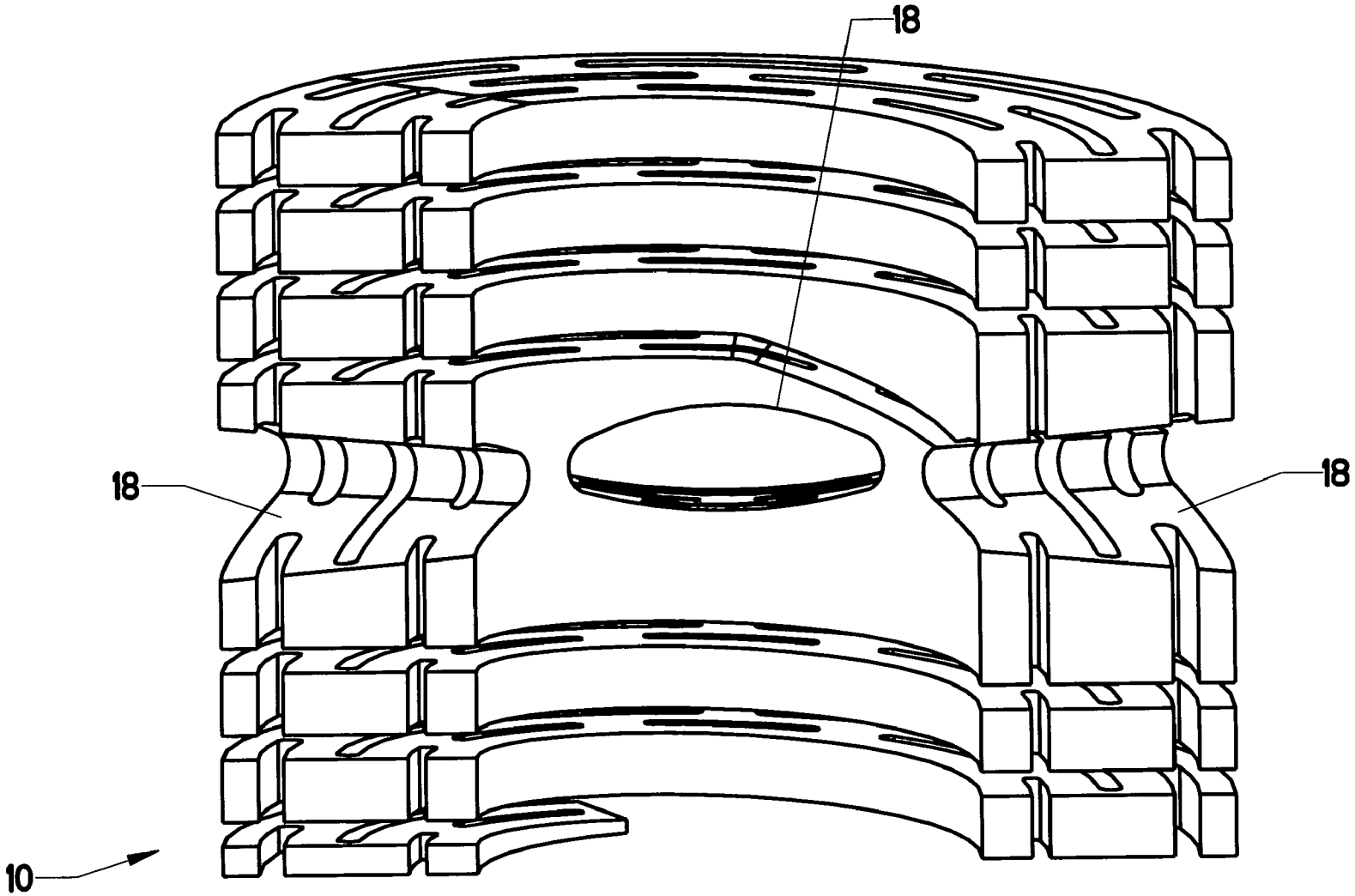
FIG. 12 is a section view, showing internal details of the embodiment of FIG. 11.

FIG. 12 shows a section view through the embodiment having elliptical ports 18. The other features are the same as the embodiment shown in FIGS. 8 through 10. The same shallow and steep pitch regions are present. The electrical path still makes approximately one turn through the region of the ports.

Figure 13:
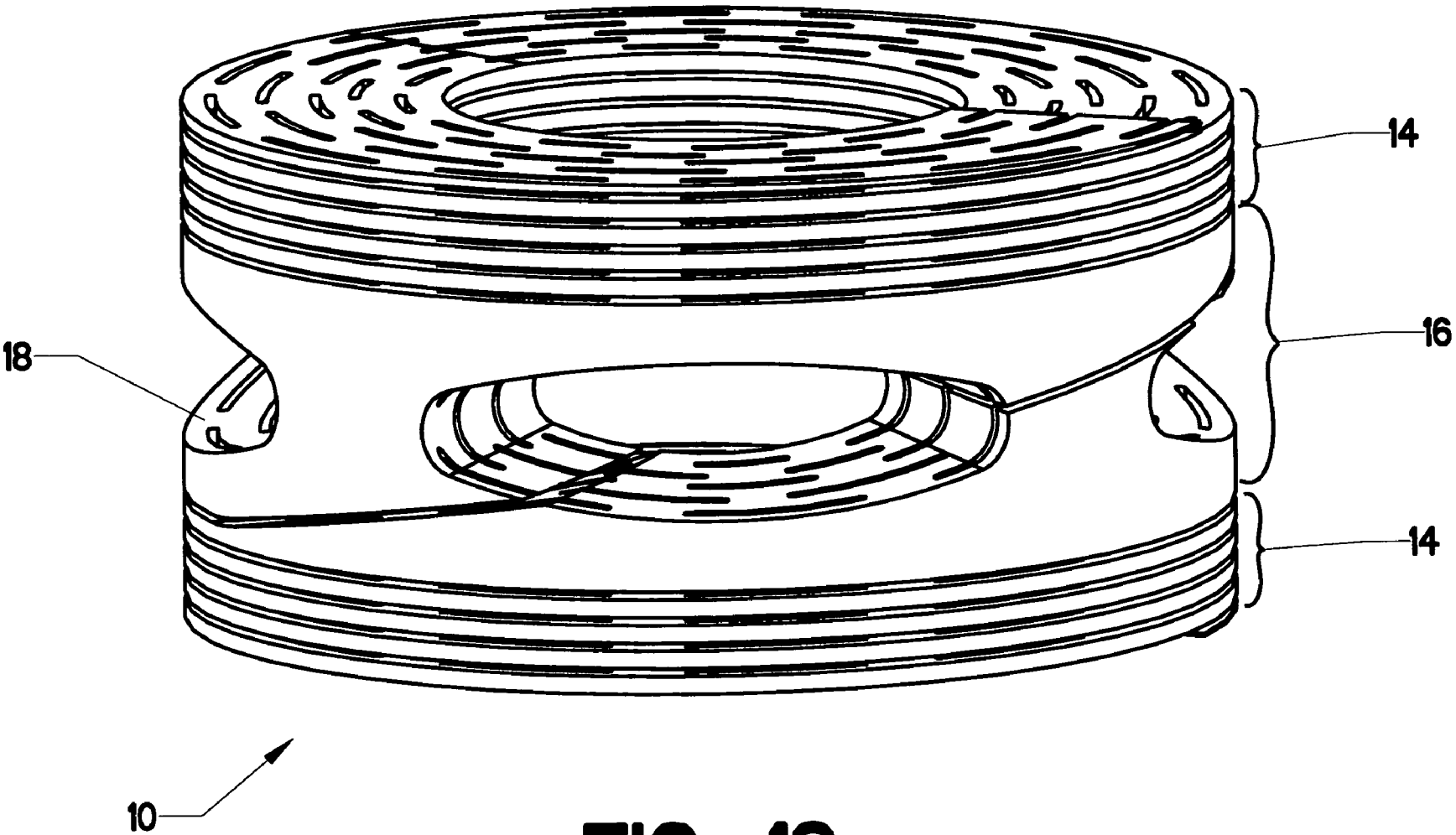
FIG. 13 is a perspective view, showing winding pitch variation in a split Florida-helix.

The embodiments shown in FIGS. 8 through 12 illustrate the main features of the split Florida-helix in an uncluttered fashion. However, actual magnet designs would typically incorporate many more turns. FIG. 13 shows a more realistic design. Shallow pitch region 14 includes a more shallow pitch for helical gap 28 and—consequently—many more conductor turns. Approximately the same steep pitch is used for steep pitch region 16.

From the description of the prior art, the reader will realize that an encompassing cooling jacket is needed to surround the split Florida-helix and force coolant to flow through the coolant slots. The existence of the ports creates a problem. The ports must be open to the magnet's exterior. However, if no liquid-tight barrier is placed within the ports, the coolant will escape. A tapered elliptical wall must therefore be placed inside elliptical ports 18. These walls must be joined to an internal wall passing through the coil's central bore. Likewise, they must be joined to an external cylindrical wall surrounding the coil's exterior. Practical manufacturing problems are immediately apparent, since joining such walls around the split Florida-helix will be very difficult.

Figure 14:
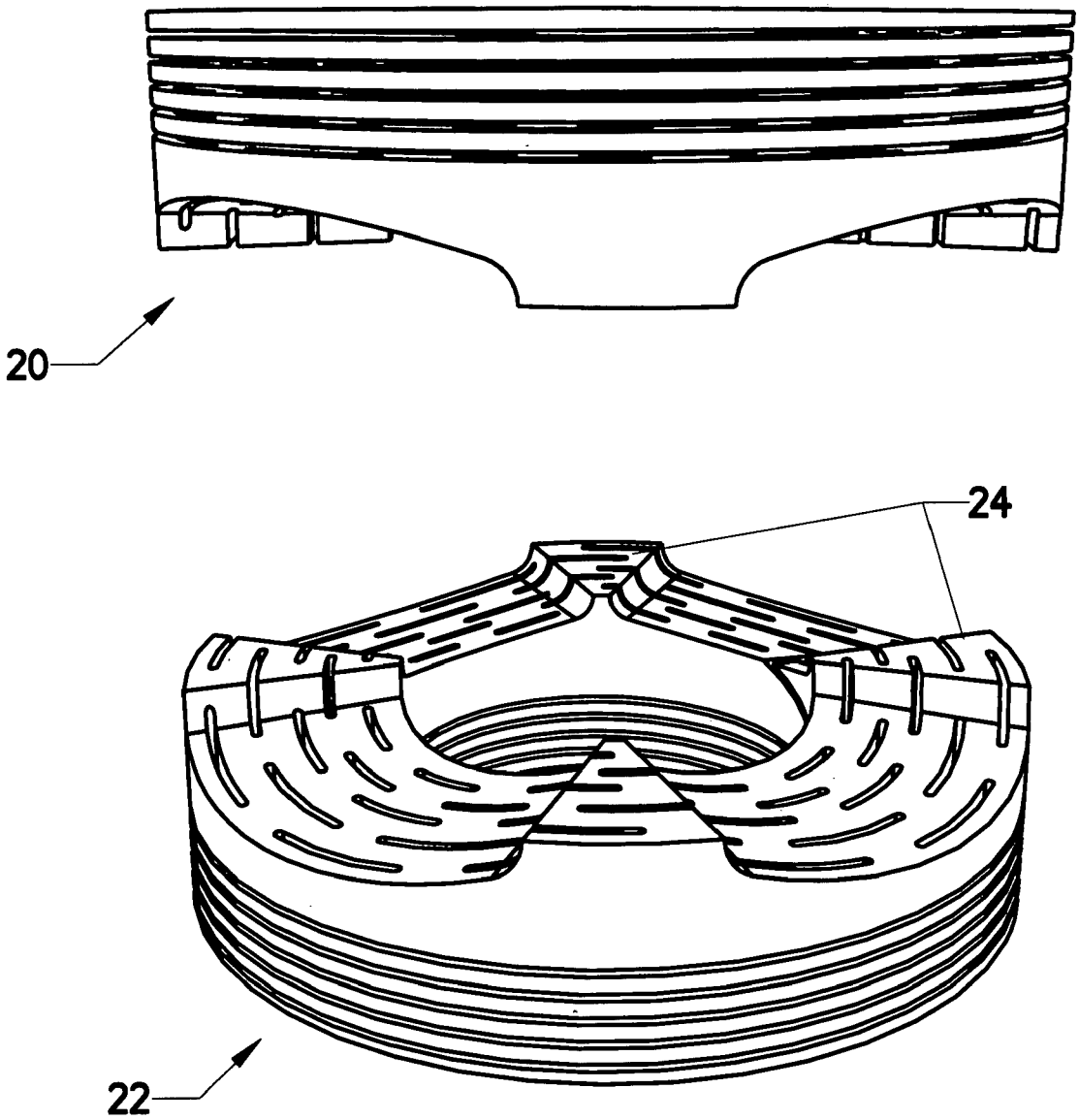
FIG. 14 is a perspective view, showing how a split Florida-helix can be divided into two halves.

FIG. 14 presents a solution to this problem. The split Florida-helix is divided into an upper and lower half. In the view these are designated as upper half split Florida-helix 20 and lower half split Florida-helix 22. Each half has four interface surfaces 24. If the two halves are clamped together, current will flow from one half to the other through these surfaces.

The actual splitting can be done by using a thin wire EDM to saw the whole version of FIG. 13 in half. It is also possible to make the two halves separately. Computer controlled EDM operations allow significant accuracy, so that the two halves will mate when they are brought together.

Figure 15:
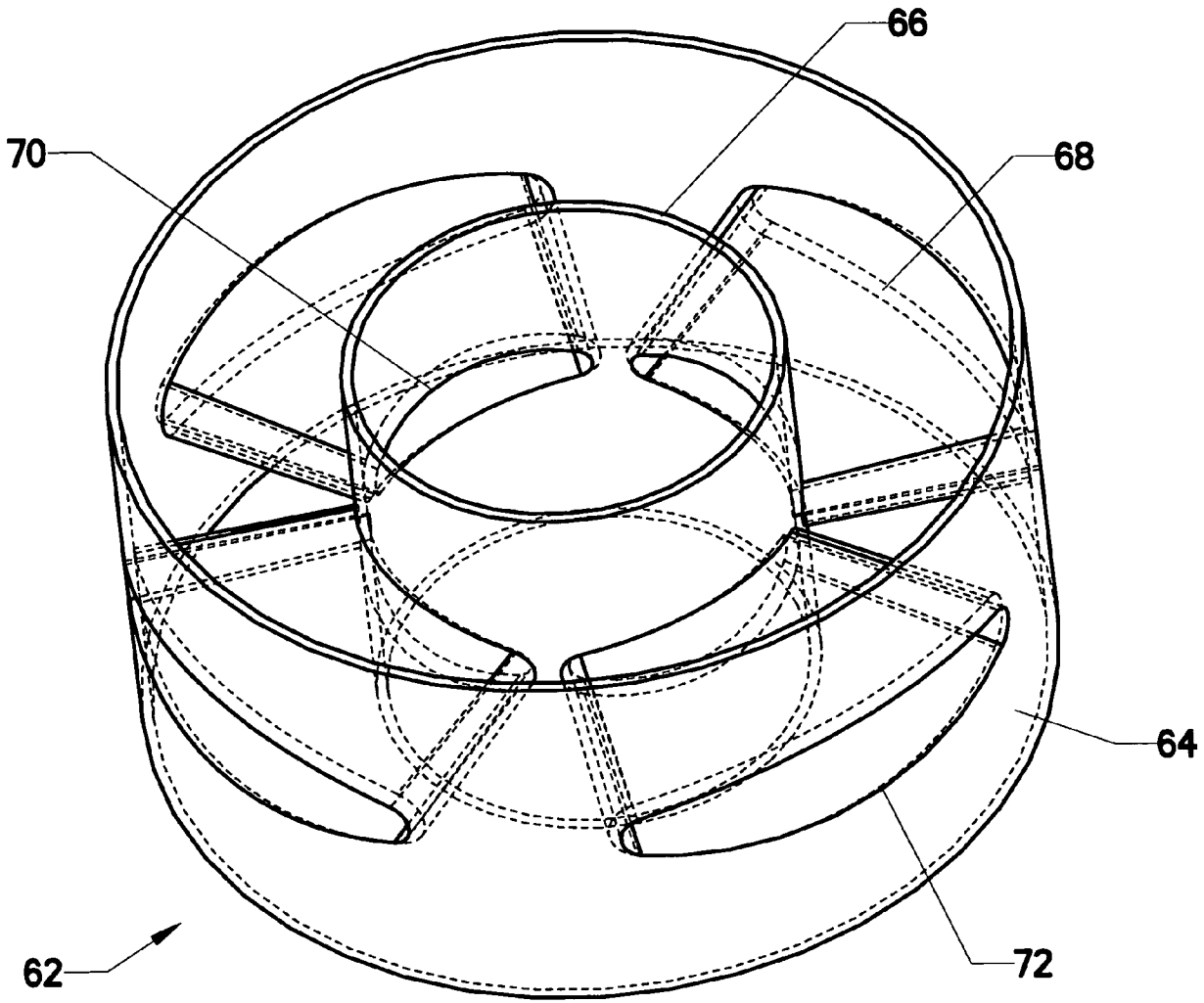
FIG. 15 is a hidden-line perspective view, showing a housing configured to allow coolant flow around the ports in a split Florida-helix.

Dividing the coil into two halves provides a manufacturing advantage. FIG. 15 shows housing 62, which is configured to house the split Florida-helix. Inner wall 66 and outer wall 64 are joined by four elliptical port bounding walls 68. Each bounding wall terminates at an inner port boundary 70 on its inner extreme and an outer port boundary 72 on its outer extreme. Thus, the housing provides four passages from its exterior to its interior. The elliptical port bounding walls may be sized to allow a slight gap between themselves and the elliptical ports, in order to allow coolant to flow around the bounding walls (which will be described in more detail subsequently). Housing 62 can be made by many conventional methods, including casting the unit as an integral piece and fabrication as a weldment of smaller pieces.

Figure 16:
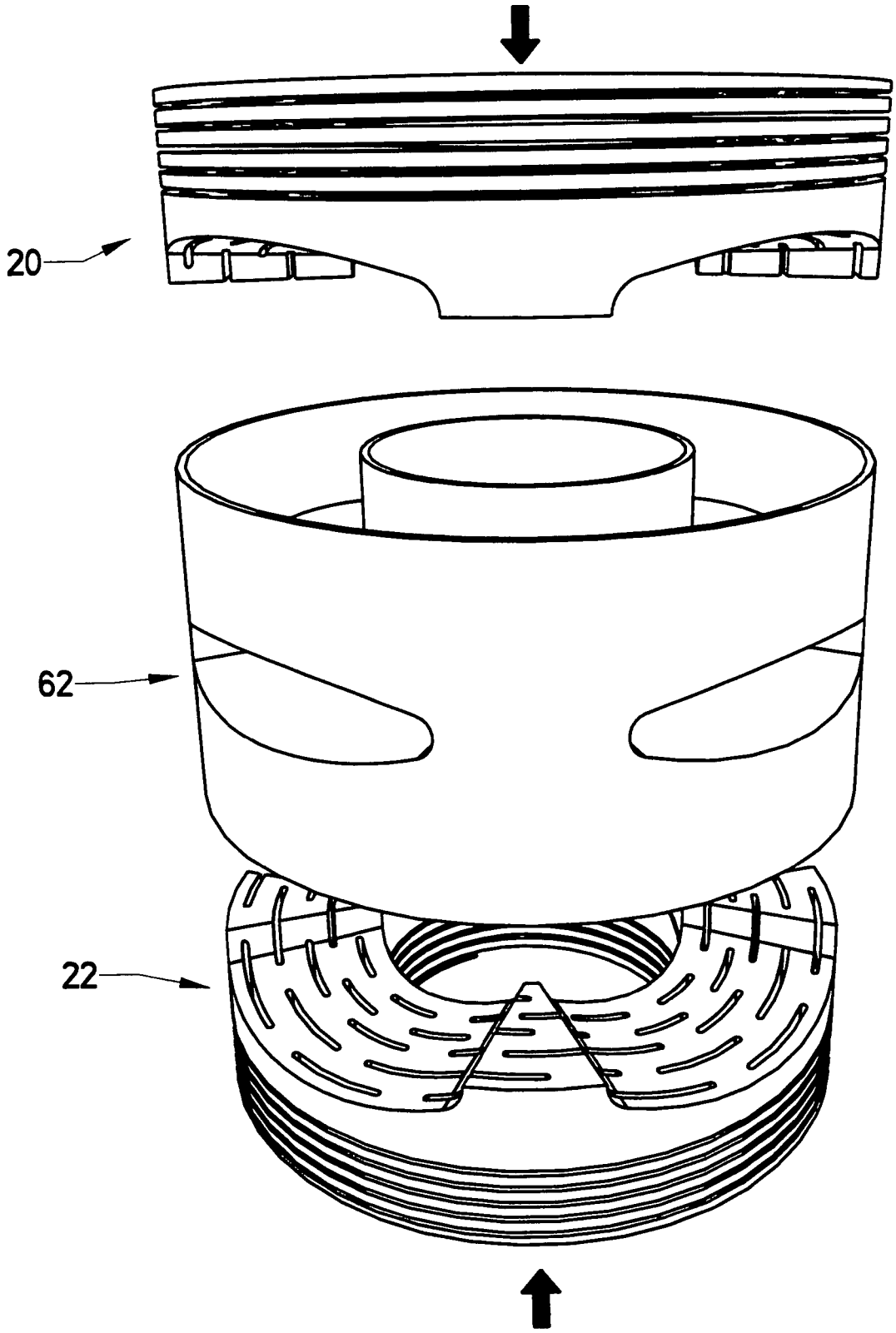
FIG. 16 is a perspective view, showing the assembly of the two halves together in the housing.
Figure 17:
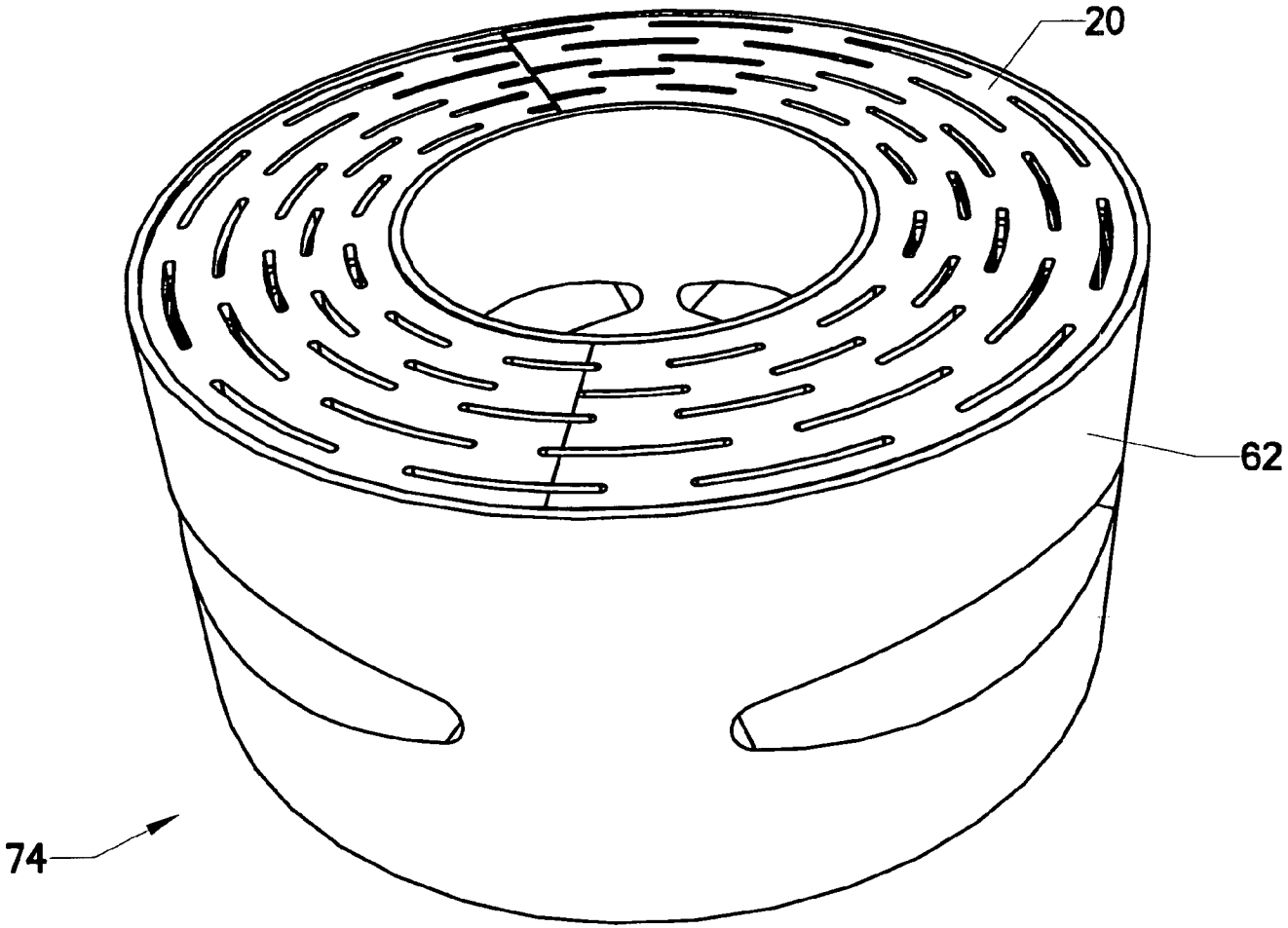
FIG. 17 is a perspective view, showing the completion of the assembly of FIG. 16.

FIG. 16 illustrates the effective combination of housing 62 and the two halves of the split Florida-helix. Upper half split Florida-helix 20 is lowered into the housing from the top, while lower half split Florida-helix 22 is lifted into the housing from the bottom (or the housing may be lowered onto the lower half). FIG. 17 shows the completed split Florida-helix assembly 74.

If a coolant feed manifold is placed over the top of the housing and a coolant collection manifold is placed over the bottom, then pressurized coolant can be fed through the cooling slots to cool the coil. The elliptical ports still provide access to the coil's interior, without compromising the fluid seal.

Figure 18:
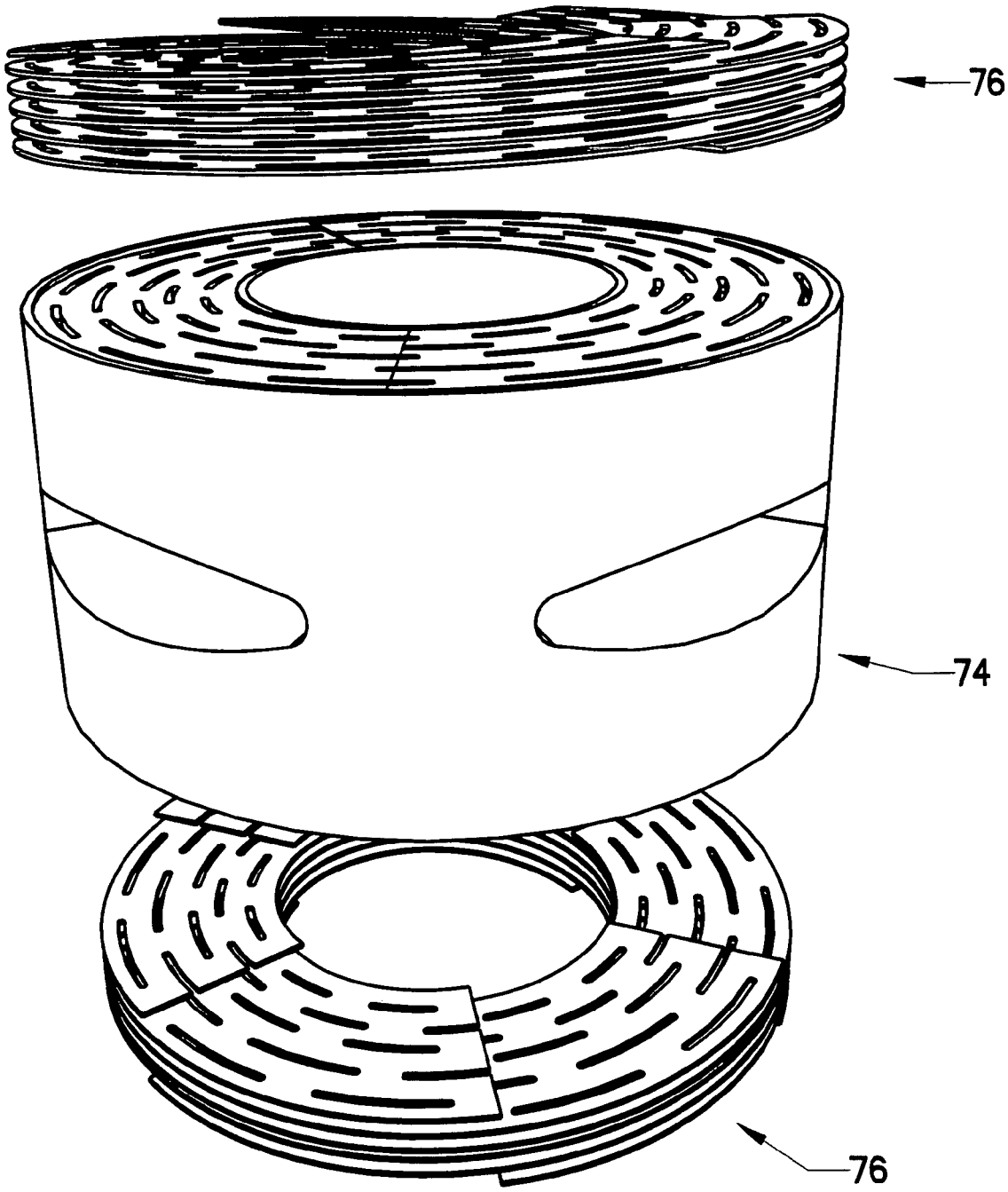
FIG. 18 is a perspective view, showing the addition of Florida-Bitter disk stacks to the assembly of FIG. 17.

Of course, the use of the split Florida-helix is particularly advantageous around the ports. Away from the ports, other methods can be used. As one example, Florida-Bitter stacks could be placed above and below split Florida-helix 74 to continue the helical current path over a longer distance. FIG. 18 shows this embodiment, with two Florida-Bitter disk stacks 76 in position and ready to be clamped to the assembly. Many such stacks could be added. Of course, the inner and outer walls of housing 62 would have to be extended upward and downward. Alternatively, separate housings for the bitter stacks could simply be attached to housing 62.

Having now seen the fundamental concepts of the split Florida-helix design, the reader may wish to know how the design could be incorporated into a large magnet. At least as of the present time, the manufacturing of the Florida-helix is more difficult than creating a Florida-Bitter stack. Thus, it may be advantageous to combine the split Florida-helix with one or more Florida-Bitter coils.

Figure 19:
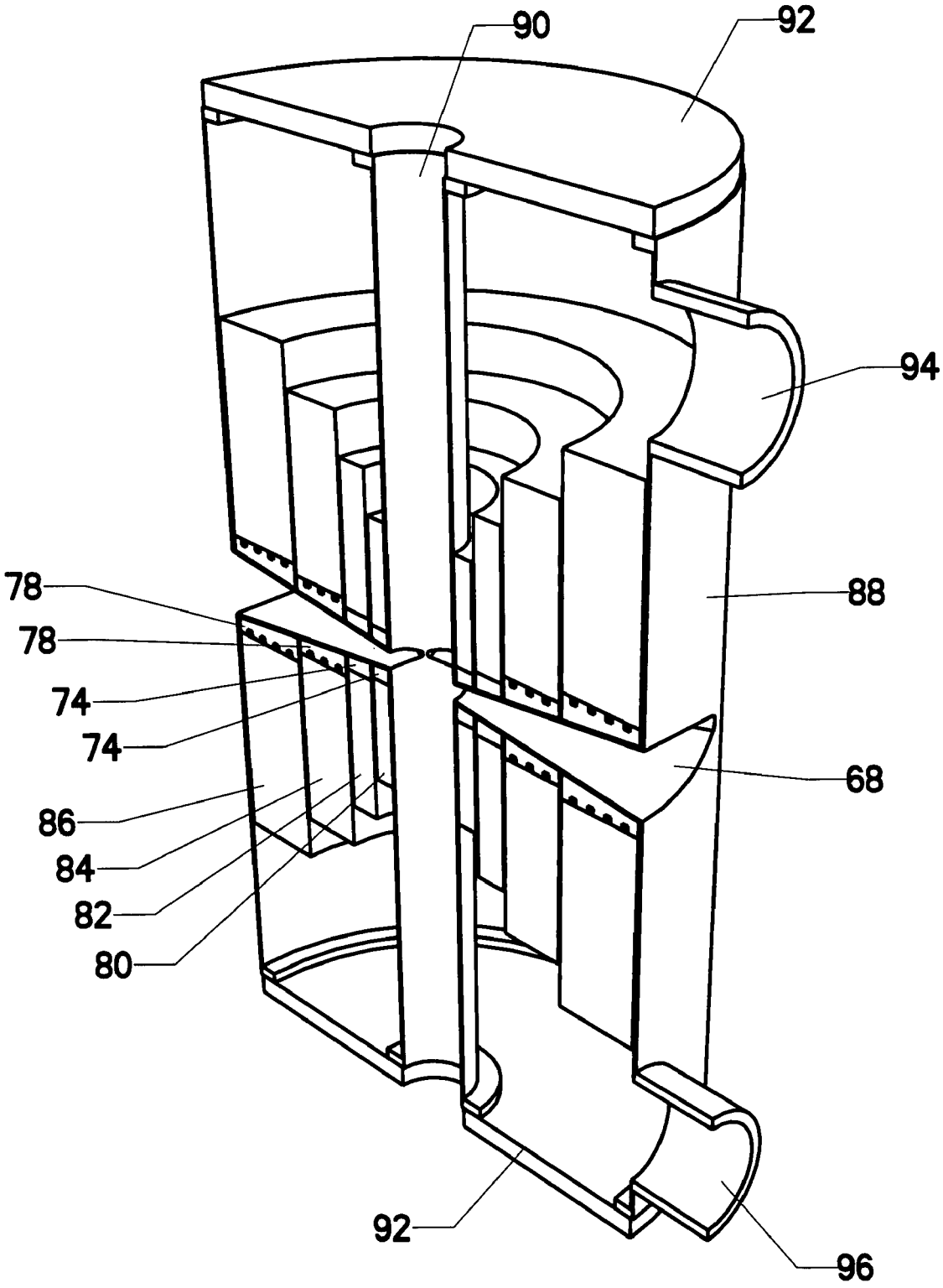
FIG. 19 is a sectioned perspective view, showing a representative multi-coil magnet constructed of nested Florida-helix and Florida-Bitter coils.
Figure 20:
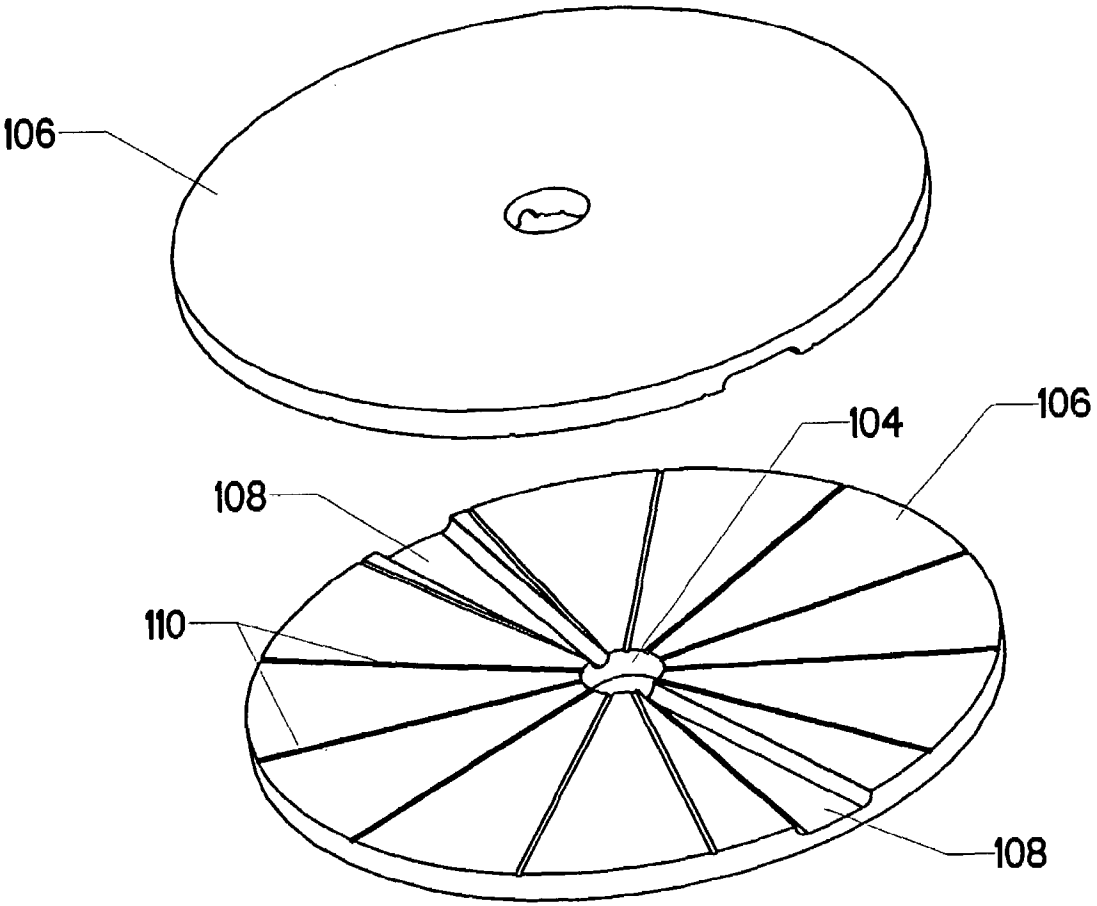
FIG. 20 (PRIOR ART)
FIG. 20 is a perspective view, showing a prior art approach to the creation of access ports.

The magnet shown sectioned in half in FIG. 19 includes such a combination. The illustration includes the fundamental components needed to illustrate the novel concepts. However, the reader should note that many commonly understood features needed to physically implement the actual design have been omitted. An actual working magnet would need to include insulated conductor paths, various fluid seals, and probably an array of tie rods to clamp the entire assembly together. None of these commonly understood features are shown. With that proviso in mind, the assembly will be explained.

The magnet's housing comprises inner housing 90, outer housing 88, and four elliptical port bounding walls (as for housing 62). The ends are sealed by a pair of end caps 92. Cooling inlet 94 feeds coolant into the housing and cooling outlet 96 removes it. Four nested coils are located concentrically within the jacket. In this version the two inner coils include a split Florida-helix assembly in the proximity of the elliptical ports.

The innermost coil has split Florida-helix assembly 74 surrounding the ports. A Florida-Bitter coil is clamped to the top and bottom of this split Florida-helix assembly (similar to the arrangement shown in FIG. 18). This Florida-Bitter coil is denoted as first Bitter coil 80. It is actually split into two portions, with half lying above the split Florida-helix assembly and half lying below.

Figure 21:
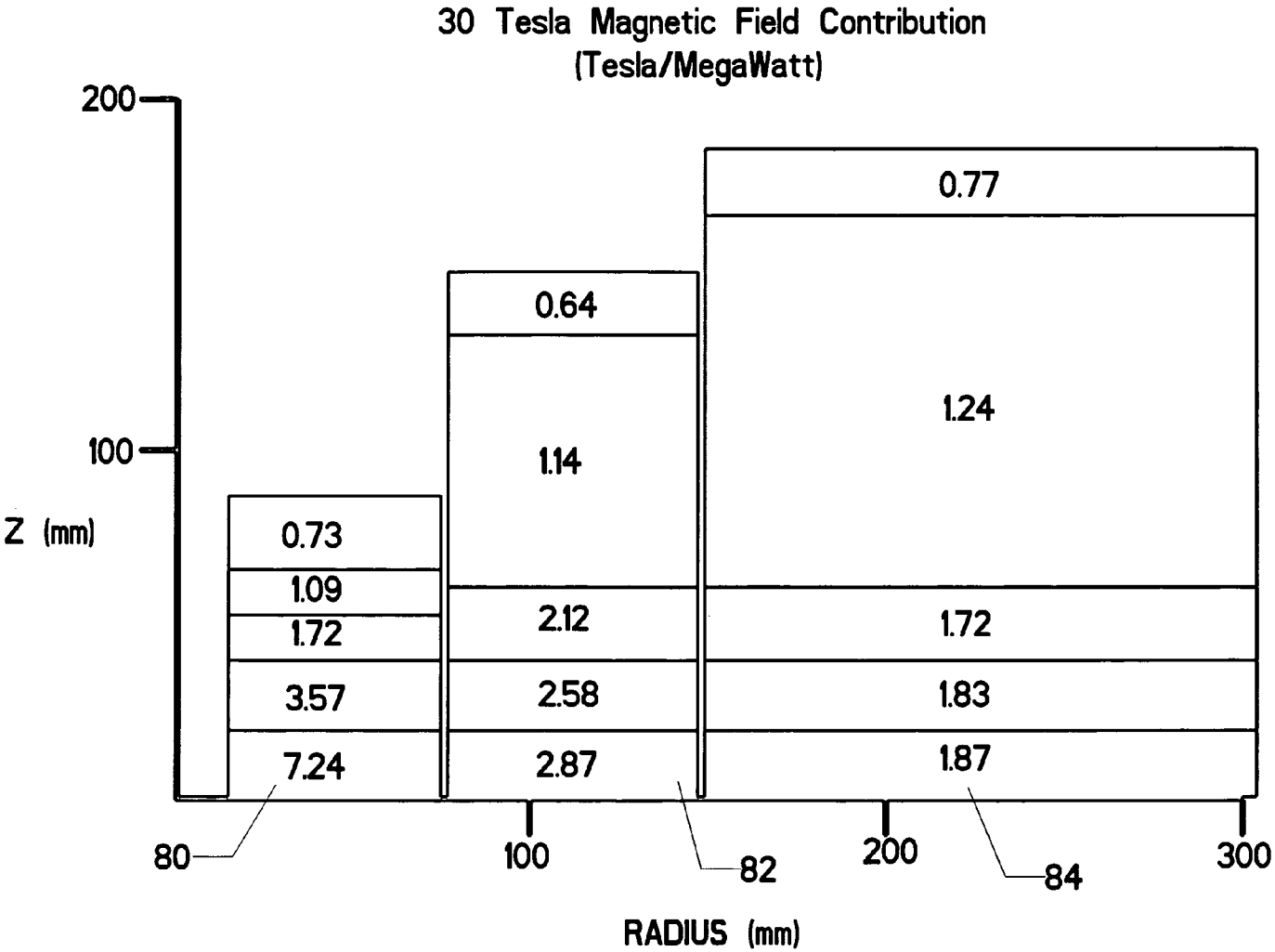
FIG. 21 is a graphical view, showing the contribution of the regions of an electromagnet to maximum field strength in the magnet's core.

The second coil also has a split Florida-helix assembly at its core. It is joined to second Bitter coil 82. Third Bitter coil 84 and fourth Bitter coil 86 do not include a split Florida-helix assembly. Instead, they include a spacer 78, which conforms to the shape of the elliptical ports (A spacer is used to simplify the design. The reader will recall from reviewing FIG. 21 that little field strength is lost by not using an elliptical current path in the outer regions of the stack). In these two outer coils, current is carried around the ports by a bridging shunt.

Figure 22:
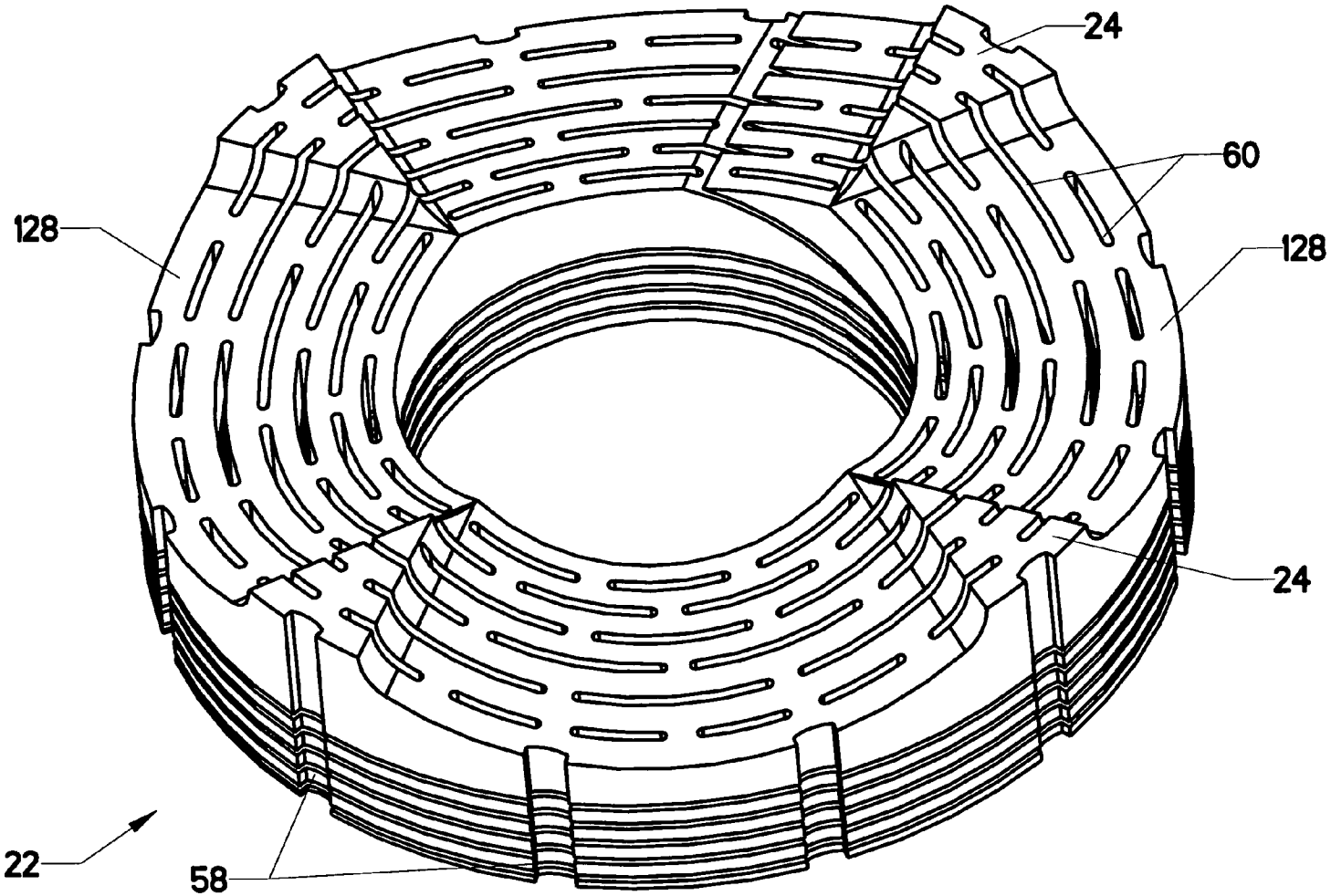
FIG. 22 is a perspective view, showing a split Florida-helix with the addition of elongated tie rod holes.

As for prior art designs, the operation of a split Florida-helix at high current densities generates substantial mechanical forces and substantial heat. These considerations obviously affect the design of a working product. FIG. 22 shows a refined embodiment of lower half split Florida helix 22. The cooling slot locations have been refined so that the cooling slots are symmetric about the centerline of each of the interface surfaces 24. This feature allows the coolant flow to divide evenly around elliptical port bounding walls 68 (which are shown in FIG. 15). The embodiment of FIG. 22 also includes a radial array of elongated tie rod holes 58. These are only half-embedded—meaning that about ½ of each tie rod's cross section actually intrudes into the split Florida-helix.

As for all the prior examples, an insulator must be placed within the helical slot to ensure that the electrical current assumes a helical path. When the embodiment of FIG. 22 is placed in a completed assembly, the array of tie rods are used to clamp the assembly tightly together. The tie rods help to resist the substantial mechanical forces generated by the magnet's operation. Lower-half-split Florida-helix 22 will be held in position largely by the engagement of the tie rods within elongated tie rod holes 58.

Of course, the embodiment shown in FIG. 22 is designed to mate with a corresponding upper half. Electrical current will pass between the two halves through the four interface surfaces 24. It is therefore important to maintain alignment between these interface surfaces. It is also important to maximize the surface area available for contact. The reader will observe in FIG. 22 that substantial surface area in the interface surfaces is lost to the cooling slots. It is therefore preferable to redirect the cooling slots around the interface surfaces.

Figure 23:
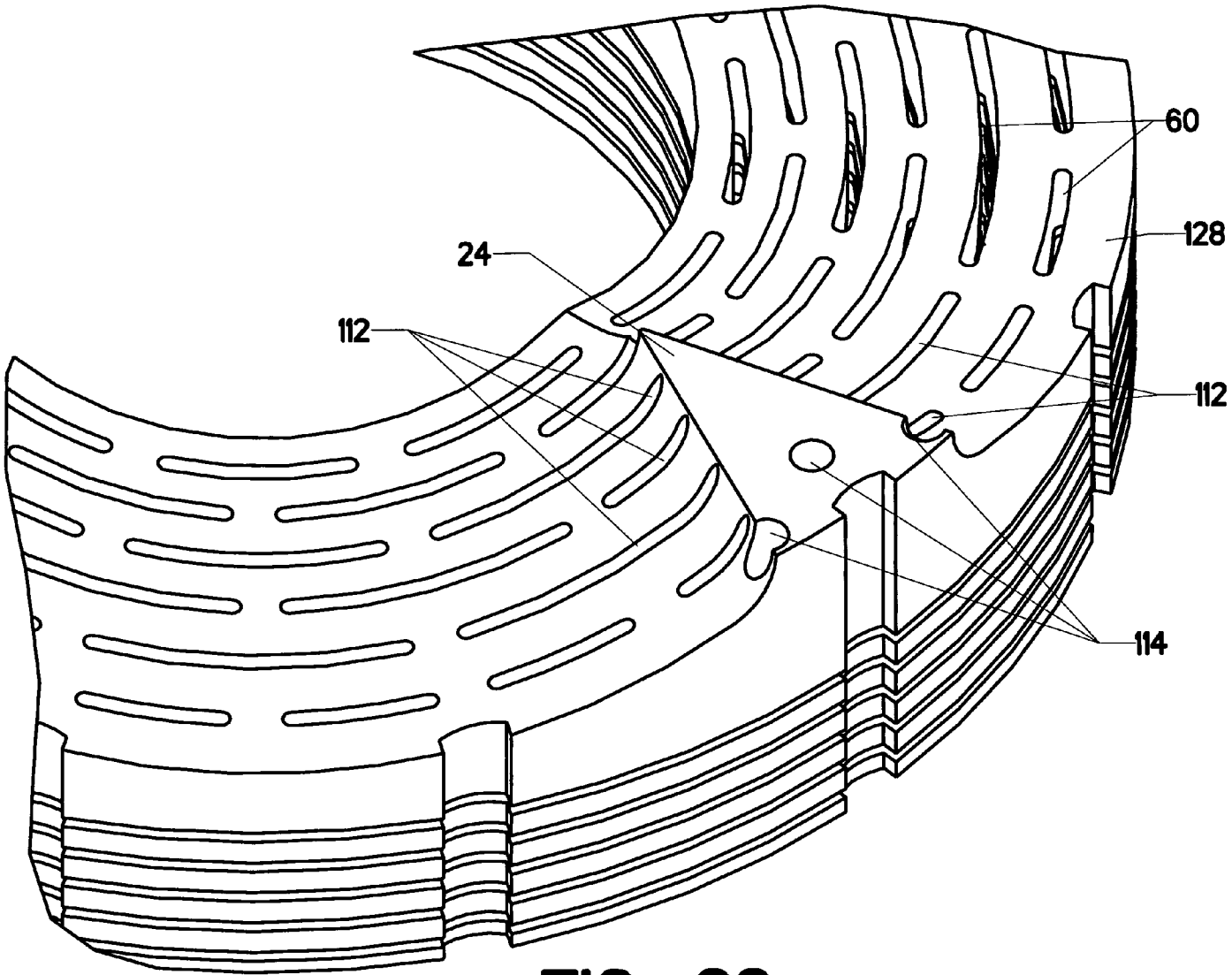
FIG. 23 is a detailed perspective view, showing a split Florida-helix with alterations made to optimize the interface surfaces.
Figure 24:
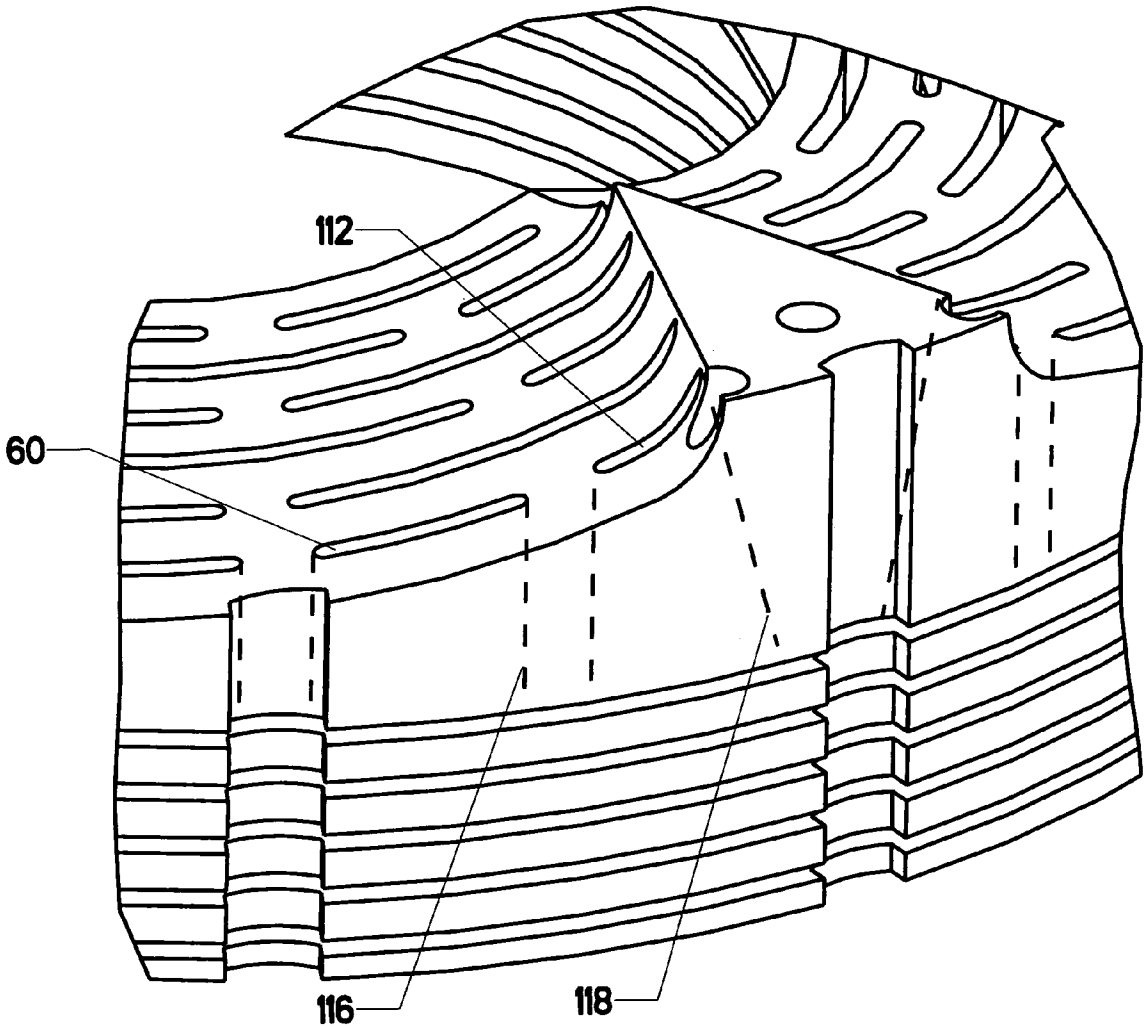
FIG. 24 is a detailed perspective view, showing the use of angled cooling slot walls near the interface surfaces.

FIG. 23 shows a detail view of another embodiment. In this version, the cooling slots have been modified to pass around the interface surfaces. Modified cooling slots 112 do not pass through the interface surface, but rather pass around it. FIG. 24 shows the same interface surface from a different perspective. The dashed lines indicate the bounding walls of the cooling slots nearest the outer perimeter. The reader will observe that the cooling slot which would have previously passed through interface surface 24 has been modified to include angled slot wall 118. The opposite end of this cooling slot is bounded by straight slot wall 116. Thus, the cooling slot which would have passed through the interface surface actually tapers in order to pass around the interface surface. The same is true for the slot found on the right side of the interface surface in the view. The same is also true for the cooling slots in the upper half of the split Florida-helix. The reader will observe that for the particular embodiment shown, eight cooling slots had to be modified for each interface surface (four per side). Of course, an actual design might include many more concentric rings of cooling slots than have been illustrated in the drawing views. Any slot that would pass into the interface surface would need to be modified.

FIG. 23 shows another modification which helps to maintain alignment between mating interface surfaces. Each interface surface includes three holes which run parallel to the magnet' central bore. These are designated as stabilizing pin receivers 114. Three rigid pins are placed within these holes, with approximately half of the pin designed to lie within the lower half of the split-Florida helix and half of the pin designed to lie within the upper half of the split-Florida helix. Thus, the pins placed in these stabilizing pin receivers help to ensure the alignment of the corresponding interface surfaces.

Figure 25:
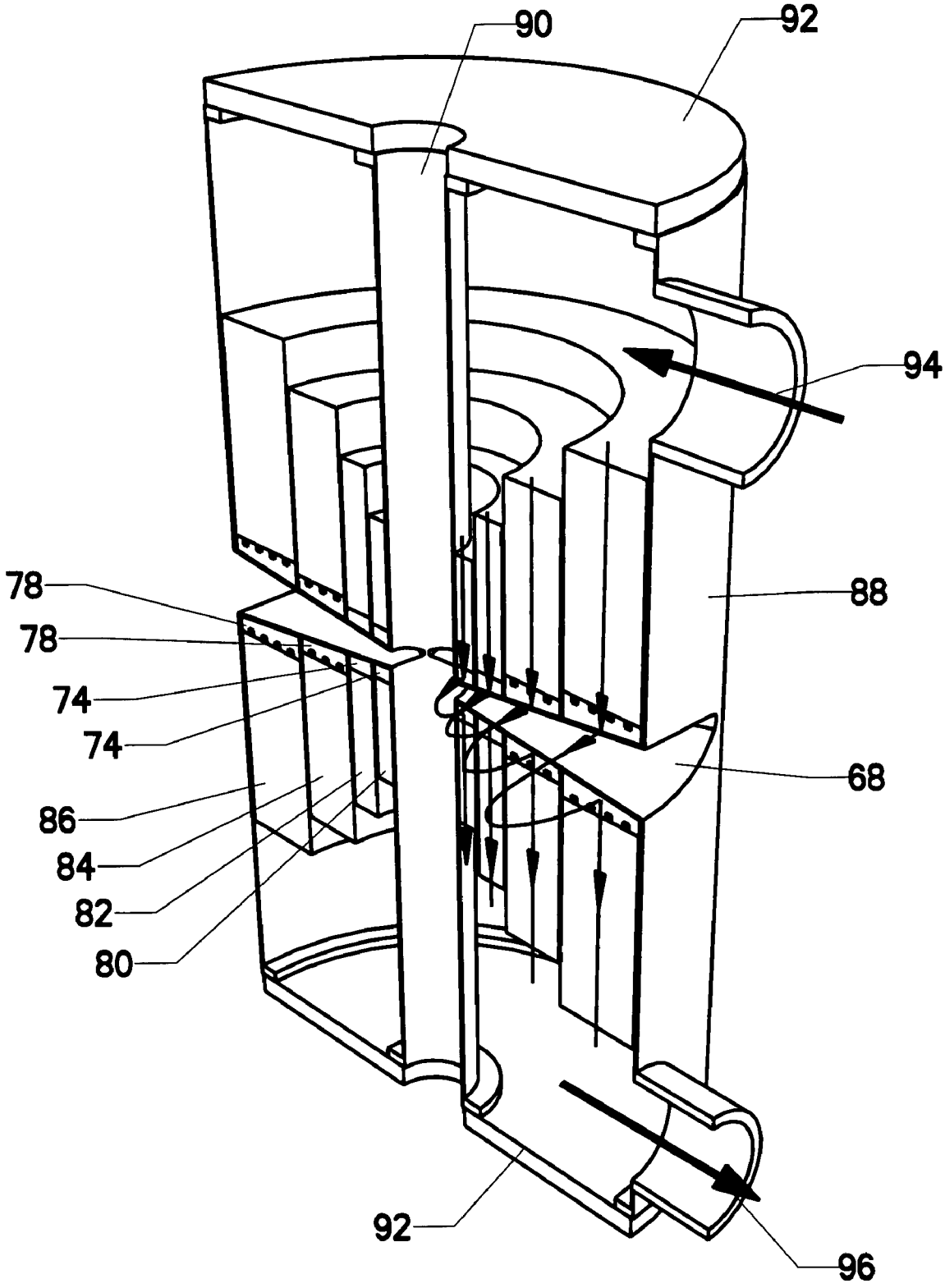
FIG. 25 is a sectioned perspective view, showing a representative multi-coil magnet constructed of nested Florida-helix and Florida-Bitter coils, and the coolant flow around the access ports.
Figure 26:
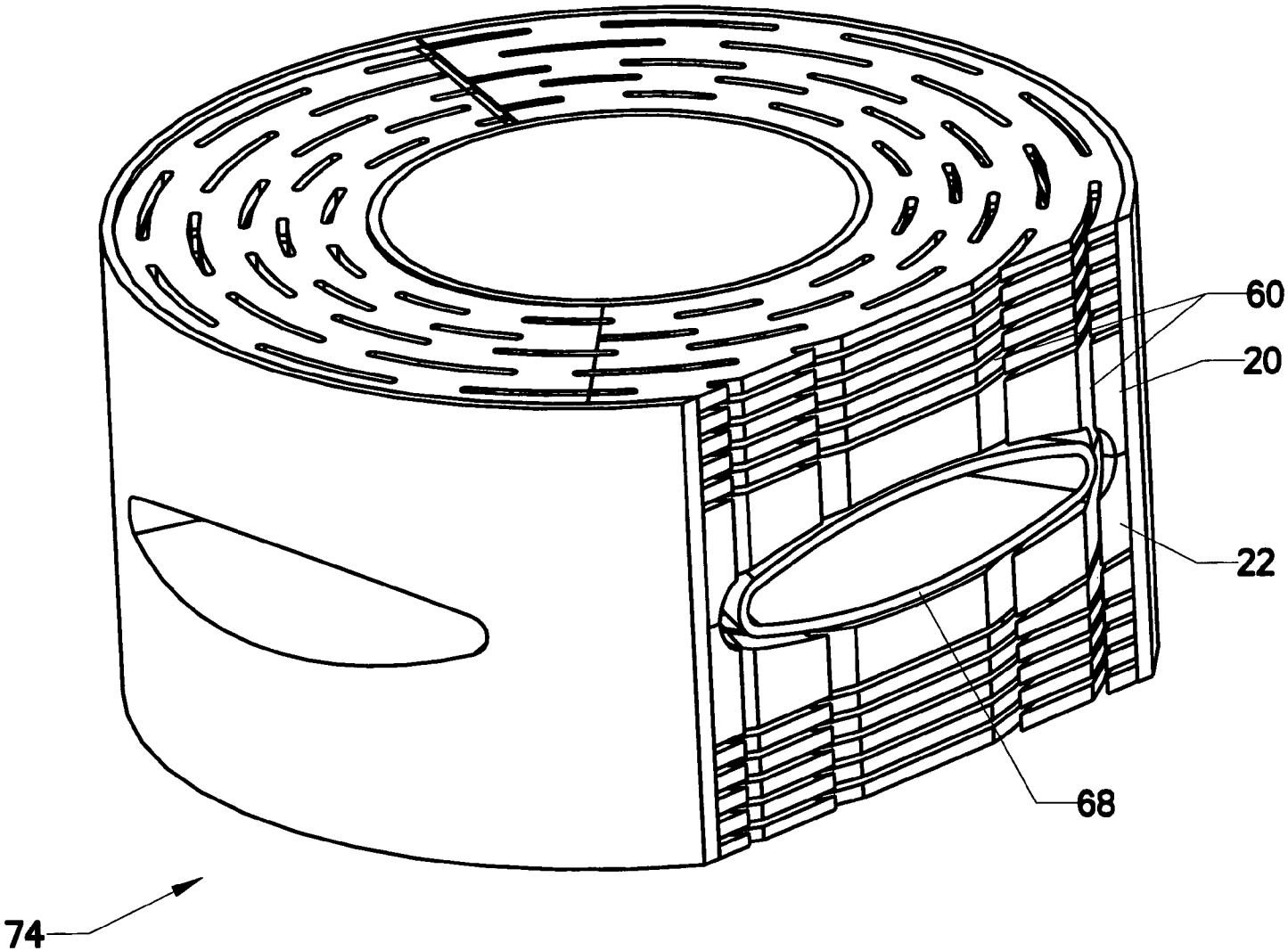
FIG. 26 is a perspective view with a cutaway, showing the geometry around a radial access port.

FIG. 25 is the same schematic depiction of a magnet incorporating split Florida-helices that was originally shown n FIG. 19. However, FIG. 25 includes arrows depicting the general flow of coolant through the magnet. Coolant flows vertically downward through each coil until it reaches the mid-plane, where it encounters the radial access ports. The coolant must then flow around the access ports before continuing downward. FIG. 26 shows split Florida-helix assembly 74 (which could comprise the mid-plane of the innermost coil in the magnet of FIG. 25). A cut has been made through the stack in order to reveal internal features. Elliptical port bounding wall 68 creates a fluid boundary which the coolant must pass around. Returning briefly to FIG. 22, the reader will note that each port through the split Florida-helix is defined by a port relief surface 128. Returning now to FIG. 26, the reader will observe that a gap exists between the exterior of elliptical port bounding wall 68 and port relief surface 128. The coolant must flow through this gap in order to pass around the port.

Figure 27:
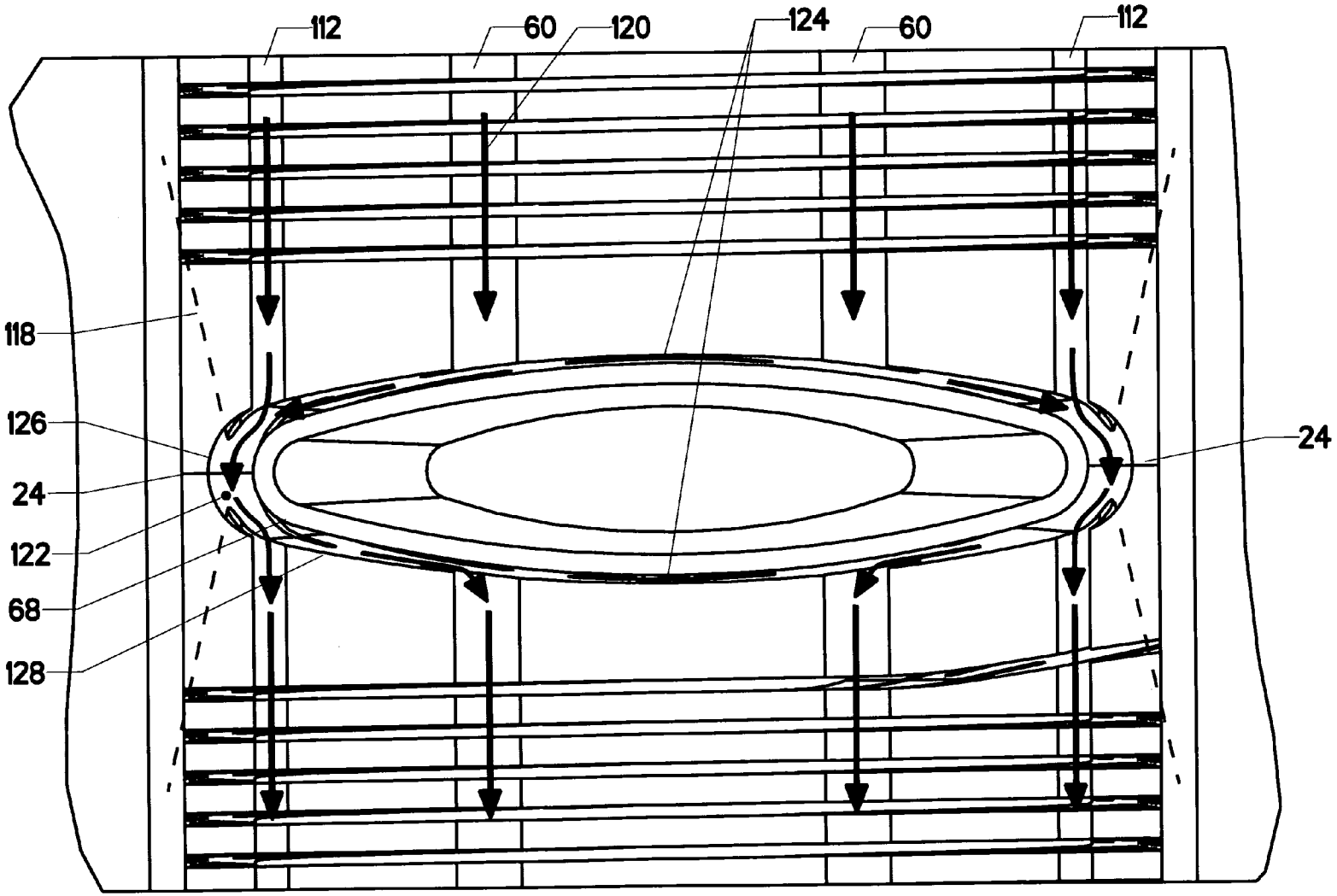
FIG. 27 is a detailed elevation view of FIG. 26, showing how coolant lows through a gap around each radial access port.

FIG. 27 shows a detailed elevation view of the cut illustrated in FIG. 26. The reader will observe how the cooling slots 60 are symmetrically arrayed about the centerlines of the access ports. The arrow depicts the flow of coolant around elliptical port bounding wall 68. Coolant flow gap 122 is created by port relief surface 128 and elliptical port bounding wall 68. The reader will observe that the gap is not constant. Near port mid point 124 the gap is relatively narrow. It then widens proceeding toward port boundary 126. The gap is preferably optimized to carry the expected flow volume. Above the port, more flow volume is encountered when proceeding from port mid point 124 toward either port boundary 126. Thus, the gap widens. Below the port, less flow volume is seen when proceeding back toward the port mid point. Thus, the gap narrows again.

FIG. 27 also shows the mating of corresponding interface surfaces 24. The dashed lines indicate angled slot walls 118 in the cooling slots that have been modified to pass around the interface surfaces.

The reader will therefore understand how the split Florida-helix can operate as a stand-alone coil, or as a part of a more complex magnet. It can also be used as a component in a resistive or hybrid magnet. Many other applications are possible. Accordingly, the scope of the invention should be set by the claims rather than by the specific examples given.

Having now described our invention, we claim:

1. An electromagnet, comprising:

a. a cylinder of conductive material having a central axis, a first end, a second end, a mid plane positioned between said first and second ends, and a central bore passing through said cylinder from said first end to said second end;

b. at least one port passing from said central bore to the exterior of said cylinder in a direction substantially perpendicular to said central axis; and c. a helical gap following a helical path along said central axis from said first end of said cylinder to said second end of said cylinder, wherein said helical gap passes from said central bore to said exterior of said cylinder in a direction substantially perpendicular to said central axis wherein said at least one port lies on said mid plane, and wherein a pitch of said helical path varies, and wherein said pitch of said helical path is relatively shallow proximate said first end and said second end; and said pitch of said helical path is relatively steep proximate said mid plane, and wherein said at least one port assumes an elliptical form which diverges when proceeding from said central axis toward said exterior of said cylinder.

2. An electromagnet as recited in claim 1, wherein said electromagnet is divided into a first half and a second half, with the division occurring proximate said mid plane.

3. An electromagnet as recited in claim 2, wherein said first half and said second half each include at least two ports separated by at least two interface surfaces, with said first half and said second half meeting at said at least two interface surfaces.

4. An electromagnet as recited in claim 3, wherein each of said at least two interface surfaces includes a stabilizing pin positioned to prevent lateral movement of said at least two interface surfaces with respect to each other.

5. An electromagnet as recited in claim 3, further comprising cooling slots running from said first end to said second end.

6. An electromagnet as recited in claim 5, wherein said cooling slots pass around said at least two interface surfaces.

7. An electromagnet as recited in claim 5, further comprising:

a. an inner wall lying within said central bore;

b. an outer wall lying outside said exterior of said cylinder;

c. at least two bounding walls joining said inner wall to said outer wall, wherein each of said at least two bounding walls lies within one of said at least two ports;

d. wherein the exterior surface of each of said bounding walls is smaller than each of said at least two ports in order to form a gap through which coolant can flow around each of said at least two bounding walls.

8. An electromagnet as recited in claim 7, wherein said cooling slots pass around said at least two interface surfaces.

9. An electromagnet as recited in claim 7, wherein each of said at least two interface surfaces includes a stabilizing pin positioned to prevent lateral movement of said at least two interface surfaces with respect to each other.

10. An electromagnet as recited in claim 1, further comprising:

a. a first Bitter coil lying proximate said first end of said conductive cylinder and electrically connected thereto; and b. a second Bitter coil lying proximate said second end of said conductive cylinder and electrically connected thereto, so that said first Bitter coil, said conductive cylinder, and said second Bitter coil combine to form a helical electrical current path.

11. An electromagnet as recited in claim 1, further comprising:

a. a first Bitter coil lying proximate said first end of said conductive cylinder and electrically connected thereto; and b. a second Bitter coil lying proximate said second end of said conductive cylinder and electrically connected thereto, so that said first Bitter coil, said conductive cylinder, and said second Bitter coil combine to form a helical electrical current path.

12. An electromagnet as recited in claim 1, further comprising:

a. a first Bitter coil lying proximate said first end of said conductive cylinder and electrically connected thereto; and b. a second Bitter coil lying proximate said second end of said conductive cylinder and electrically connected thereto, so that said first Bitter coil, said conductive cylinder, and said second Bitter coil combine to form a helical electrical current path.

13. An electromagnet as recited in claim 1, further comprising:

a. a first Bitter coil lying proximate said first end of said conductive cylinder and electrically connected thereto; and b. a second Bitter coil lying proximate said second end of said conductive cylinder and electrically connected thereto, so that said first Bitter coil, said conductive cylinder, and said second Bitter coil combine to form a helical electrical current path.

14. An electromagnet as recited in claim 2, further comprising:

a. a first Bitter coil lying proximate said first end of said conductive cylinder and electrically connected thereto; and b. a second Bitter coil lying proximate said second end of said conductive cylinder and electrically connected thereto, so that said first Bitter coil, said conductive cylinder, and said second Bitter coil combine to form a helical electrical current path.

15. An electromagnet as recited in claim 3, further comprising:

a. a first Bitter coil lying proximate said first end of said conductive cylinder and electrically connected thereto; and b. a second Bitter coil lying proximate said second end of said conductive cylinder and electrically connected thereto, so that said first Bitter coil, said conductive cylinder, and said second Bitter coil combine to form a helical electrical current path.

16. An electromagnet as recited in claim 5, further comprising:

a. a first Bitter coil lying proximate said first end of said conductive cylinder and electrically connected thereto; and b. a second Bitter coil lying proximate said second end of said conductive cylinder and electrically connected thereto, so that said first Bitter coil, said conductive cylinder, and said second Bitter coil combine to form a helical electrical current path.

* * * * *